US006603450B1

(12) United States Patent
Yamazaki et al.

(10) Patent No.: US 6,603,450 B1
(45) Date of Patent: Aug. 5, 2003

(54) IMAGE FORMING APPARATUS AND IMAGE FORMING METHOD

(75) Inventors: Tatsuro Yamazaki, Machida (JP); Naoto Abe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/324,651

(22) Filed: Jun. 3, 1999

(30) Foreign Application Priority Data

Jun. 5, 1998 (JP) ..... 10-157423
Jun. 1, 1999 (JP) ..... 11-153806

(51) Int. Cl.[7] ..... G09G 3/22
(52) U.S. Cl. ..... 345/75.2; 345/76
(58) Field of Search ..... 345/74.1, 147, 345/75.1, 75.2, 77; 315/169.3

(56) References Cited

U.S. PATENT DOCUMENTS

| | | | | |
|---|---|---|---|---|
| 4,554,539 A | * | 11/1985 | Graves | 315/169.3 |
| 4,904,895 A | | 2/1990 | Tsukamoto et al. | 313/336 |
| 5,066,883 A | | 11/1991 | Yoshioka et al. | 313/309 |
| 5,262,698 A | * | 11/1993 | Dunham | 315/169.1 |
| 5,455,597 A | | 10/1995 | Nakamura et al. | 345/75 |
| 5,627,556 A | * | 5/1997 | Kwon et al. | 345/76 |
| 5,659,329 A | | 8/1997 | Yamanobe et al. | 345/74 |
| 5,744,914 A | | 4/1998 | Konishi | 315/169.1 |
| 5,818,403 A | | 10/1998 | Nakamura et al. | 345/74 |
| 5,956,004 A | * | 9/1999 | Hush et al. | 345/74.1 |
| 6,144,350 A | * | 11/2000 | Fujii et al. | 345/74.1 |
| 6,184,874 B1 | * | 2/2001 | Smith et al. | 345/204 |

FOREIGN PATENT DOCUMENTS

| | | |
|---|---|---|
| JP | 64-31332 | 2/1989 |
| JP | 2-257551 | 10/1990 |
| JP | 3-55738 | 3/1991 |
| JP | 3-129698 | 6/1991 |
| JP | 4-28137 | 1/1992 |

(List continued on next page.)

OTHER PUBLICATIONS

H. Araki, et al., "Electroforming and Electron Emission of Carbon Thin Films", Journal of the Vacuum Society of Japan, vol. 26, No. 1, pp. 22–29 (Jan. 26, 1983).
M.I. Elinson, et al., "The Emission of Hot Electrons and the Field Emission of Electrons From Tin Oxide", Radio Engineering and Electronic Physics, No. 7, pp. 1290–1296 (Jul. 1965).

(List continued on next page.)

*Primary Examiner*—Richard Hjerpe
*Assistant Examiner*—Kevin M. Nguyen
(74) *Attorney, Agent, or Firm*—Fitzpatrick, Cella, Harper & Scinto

(57) ABSTRACT

This invention suppresses power consumption in an image forming apparatus using an electron-emitting device.

For this purpose, an image forming apparatus has a plurality of electron-emitting devices, a light-emitting substance for emitting light by irradiation of electrons emitted by the electron-emitting devices, a first potential application means for sequentially selecting the plurality of electron-emitting devices and applying, to a selected electron-emitting device, a predetermined potential different from a potential applied to an unselected electron-emitting device, and a second potential application means for applying a potential corresponding to an image signal to at least a selected electron-emitting device. In this image forming apparatus, when the light-emitting substance is not required to emit light by irradiation of electrons from the selected electron-emitting device, a voltage applied to the selected electron-emitting device is set around the threshold of emission/non-emission of the light-emitting substance by irradiation of electrons from the electron-emitting device.

18 Claims, 32 Drawing Sheets

DRIVING VOLTAGE VS. EMISSION LUMINANCE CHARACTERISTIC OF DISPLAY PANEL USING SURFACE-CONDUCTION EMISSION TYPE ELECTRON-EMITTING DEVICE

FOREIGN PATENT DOCUMENTS

| | | |
|---|---|---|
| JP | 6-289814 | 10/1994 |
| JP | 6-342636 | 12/1994 |
| JP | 8-025559 | 1/1996 |
| JP | 8-306327 | 11/1996 |
| JP | 9-120268 | 5/1997 |
| JP | 9-230818 | 9/1997 |
| JP | 9-251277 | 9/1997 |
| JP | 9-319327 | 12/1997 |
| JP | 10-31450 | 2/1998 |
| WO | WO 96/41327 | 12/1996 |

OTHER PUBLICATIONS

G. Dittmer, "Electrical Conduction and Electron Emission of Discontinuous Thin Films", Thin Solid Films,, pp. 317–328 (1972).

M. Hartwell, et al., "Strong Electron Emission From Patterned Tin–Indium Oxide Thin Films", International Electron Devices Meeting, pp. 519–521 (1975).

W.P. Dyke, et al., "Field Emission", Advances in Electronics and Electron Physics, vol. 8, pp. 89–185 (1956).

C.A. Spindt, et al., "Physical Properties of Thin–Film Field Emission Cathodes With Molybdenum Cones", Journal of Applied Physics, vol. 47, No. 12, pp. 5248–5263 (Dec. 1976).

C.A. Mead, "Operation of Tunnel–Emission Devices", Journal of Applied Physics, vol. 32, No. 4, pp. 646–652 (Apr. 1961).

R. Meyer, "Recent Development on "Microtips" Display at LETI", Technical Digest of IVMC, 91, pp. 6–9 (1991).

* cited by examiner

HIGH-VOLTAGE POWER SOURCE
P10
P2000 DISPLAY PANEL (m ROW*n COLUMN)
P2001
P2002
P2003
P7 COLUMN WIRING DRIVER
P6 LUMINANCE SIGNAL SAMPLER
X SHIFT REGISTER (1 bit *n)
Buf2
SWd
SWh
SWs
Ch
Cs
SWy
P11
-Vy
GND
P8
Buf
P1002
Y SHIFT REGISTER 1 bit *m
P9
ROW WIRING DRIVER
TIMING GENERATOR
P5
CLK GENERATOR
P4
SYNC SEPARATOR
P2
ANALOG PROCESSOR
P3
P1
VIDEO SIGNAL INPUT DRIVING VOLTAGE VS. EMISSION LUMINANCE CHARACTERISTIC OF DISPLAY PANEL USING SURFACE-CONDUCTION EMISSION TYPE ELECTRON-EMITTING DEVICE EXAMPLE OF OPERATION DRIVING VOLTAGE OF DISPLAY PANEL USING SURFACE-CONDUCTION EMISSION TYPE ELECTRON-EMITTING DEVICE HIGH-VOLTAGE POWER SOURCE
P10
P2000 DISPLAY PANEL (m ROW*n COLUMN)
P2001
P2002
P2003
P17 COLUMN WIRING DRIVER
DAC
P16 S-P CONVERTER
LATCH (8 bit*nch)
SHIFT REGISTER (8 bit*n)
P1101
SWy
P11
-Vy
GND
P1002
Y SHIFT REGISTER 1 bit*m
P9 ROW WIRING DRIVER
buf
OFFSET VOLTAGE GENERATOR
P18
VOLTAGE Vref GENERATOR
P19
P14
TIMING GENERATOR
P5
A/D
P12
CLAMP PULSE
ANALOG PROCESSOR
P3
CLK GENERATOR
P4
SYNC SEPARATOR
P2
P1 VIDEO SIGNAL INPUT

OUTPUT CHARACTERISTIC OF DAC IN COLUMN WIRING DRIVER

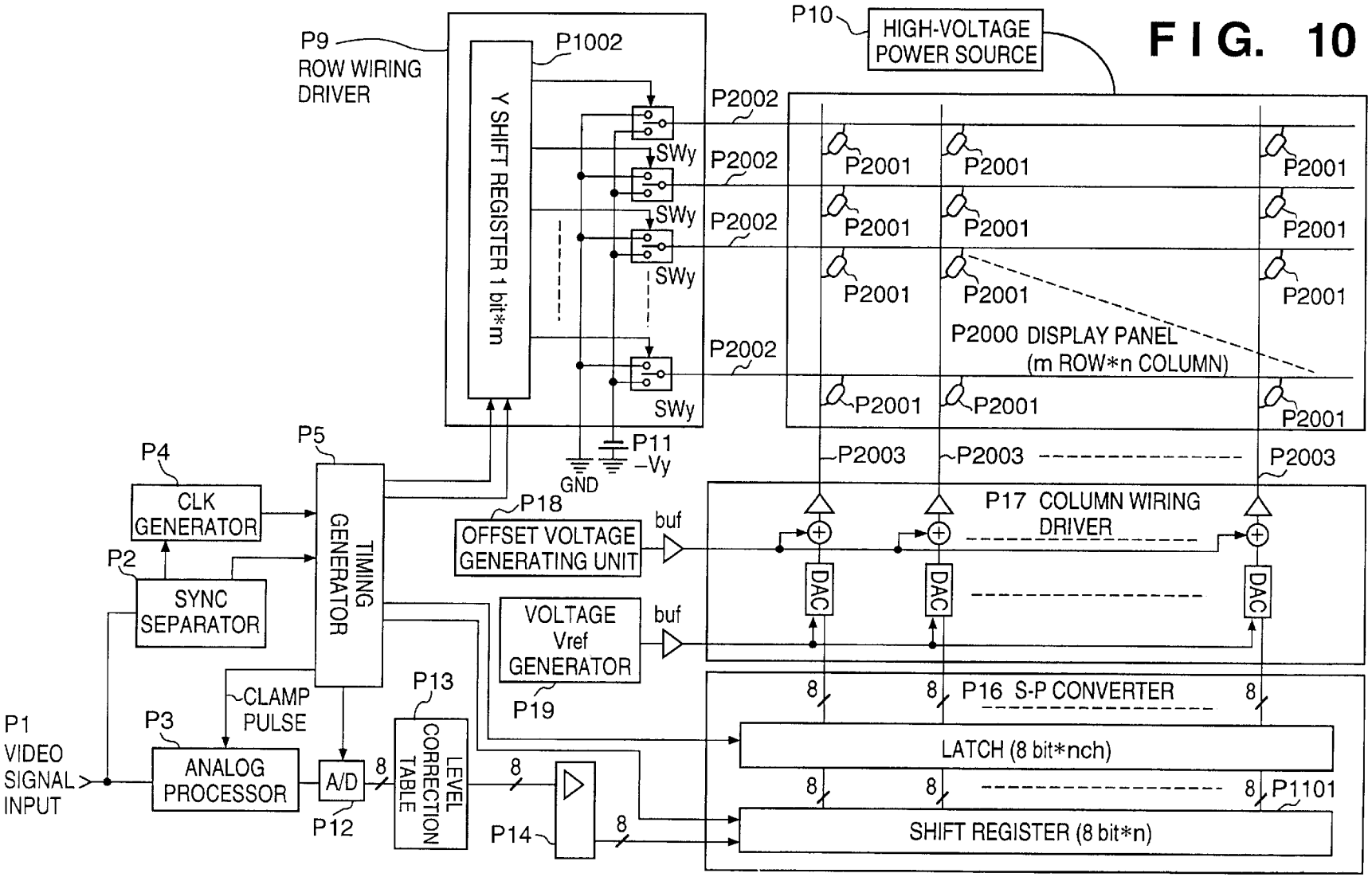
FIG. 10
HIGH-VOLTAGE POWER SOURCE
P10
P2001
P2002
P2003
P2000 DISPLAY PANEL (m ROW*n COLUMN)
P17 COLUMN WIRING DRIVER
DAC
P16 S-P CONVERTER
LATCH (8 bit*nch)
P1101
SHIFT REGISTER (8 bit*n)
P1002
SWy
P11
-Vy
GND
Y SHIFT REGISTER 1 bit*m
P9 ROW WIRING DRIVER
buf
OFFSET VOLTAGE GENERATING UNIT
P18
VOLTAGE Vref GENERATOR
P19
P14
LEVEL CORRECTION TABLE
P13
TIMING GENERATOR
P5
A/D
P12
CLAMP PULSE
ANALOG PROCESSOR
P3
CLK GENERATOR
P4
SYNC SEPARATOR
P2
P1 VIDEO SIGNAL INPUT T501 INPUT VIDEO SIGNAL
T502 SYNC SIGNAL
T503 CLK
T510 COLOR SAMPLE DATA
T504 LUMINANCE DATA
T505 SFTCLK
T506 LD
T507
R_E PULSE
G_E PULSE
B_E PULSE
T508
GIVEN R OUTPUT COLUMN
GIVEN G OUTPUT COLUMN
GIVEN B OUTPUT COLUMN
Vref
VbR
VbG
VbB
GND
T509
FIRST ROW OUTPUT
SECOND ROW OUTPUT
THIRD ROW OUTPUT
mTH ROW OUTPUT
–Vy
SECOND LINE
THIRD LINE
FOURTH LINE
mTH LINE
FIRST LINE
SECOND LINE
THIRD LINE
mTH LINE

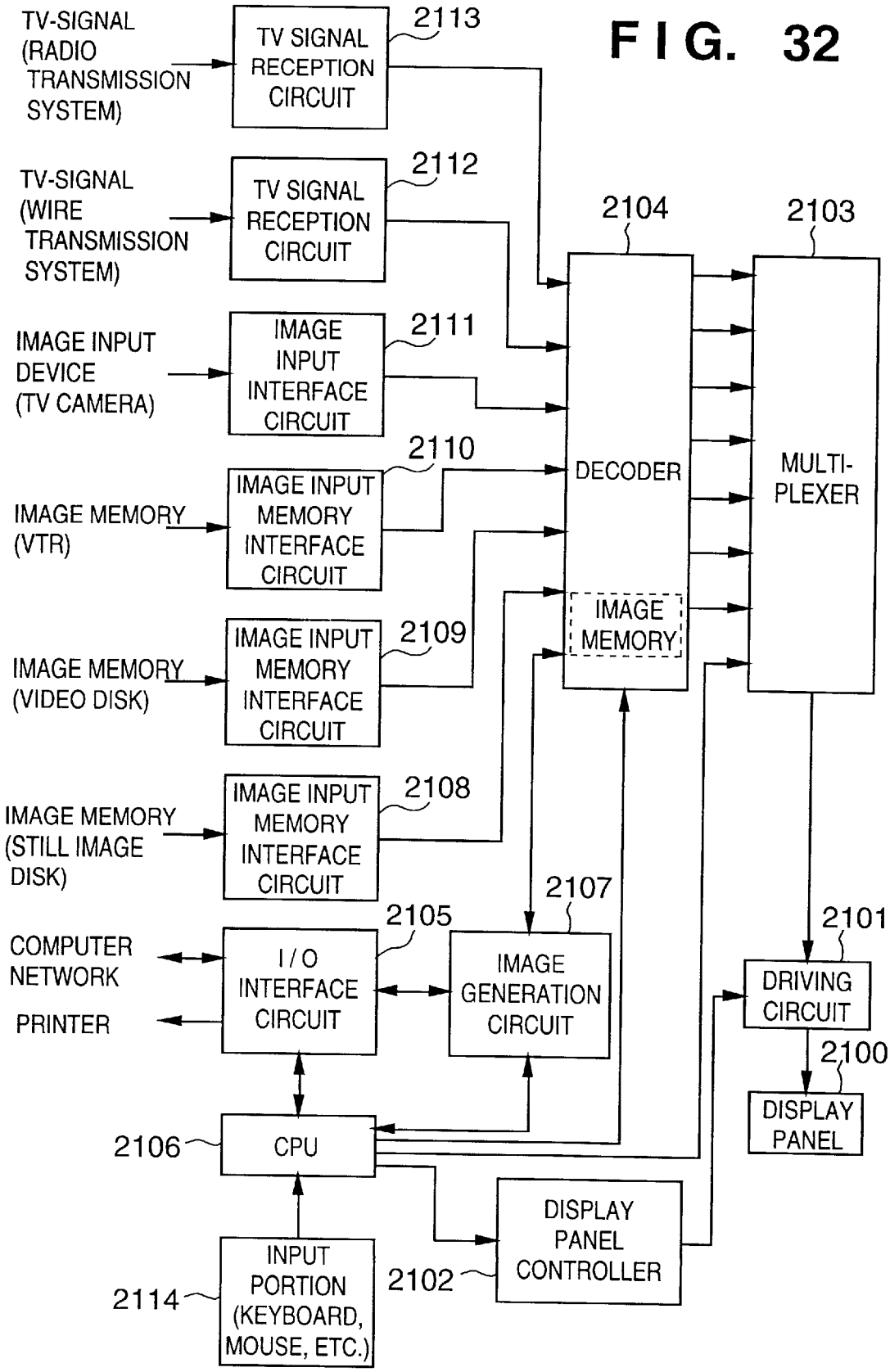
FIG. 32
TV-SIGNAL (RADIO TRANSMISSION SYSTEM)
TV SIGNAL RECEPTION CIRCUIT
2113
TV-SIGNAL (WIRE TRANSMISSION SYSTEM)
TV SIGNAL RECEPTION CIRCUIT
2112
IMAGE INPUT DEVICE (TV CAMERA)
IMAGE INPUT INTERFACE CIRCUIT
2111
IMAGE MEMORY (VTR)
IMAGE INPUT MEMORY INTERFACE CIRCUIT
2110
IMAGE MEMORY (VIDEO DISK)
IMAGE INPUT MEMORY INTERFACE CIRCUIT
2109
IMAGE MEMORY (STILL IMAGE DISK)
IMAGE INPUT MEMORY INTERFACE CIRCUIT
2108
2104
DECODER
IMAGE MEMORY
2103
MULTI-PLEXER
COMPUTER NETWORK
PRINTER
I/O INTERFACE CIRCUIT
2105
IMAGE GENERATION CIRCUIT
2107
2101
DRIVING CIRCUIT
2100
DISPLAY PANEL
2106
CPU
DISPLAY PANEL CONTROLLER
2102
2114
INPUT PORTION (KEYBOARD, MOUSE, ETC.)

IMAGE FORMING APPARATUS AND IMAGE FORMING METHOD

BACKGROUND OF THE INVENTION

1. Field of the Invention

The present invention relates to an image forming apparatus and image forming method for irradiating a light-emitting substance with electrons.

2. Description of the Related Art

A technique of forming an image by irradiating a light-emitting substance with electrons has conventionally been known. A well-known example of this technique is a CRT.

Two types of devices, namely hot and cold cathode devices, are known as electron-emitting devices. Known examples of the cold cathode devices are surface-conduction type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction type electron-emitting devices is described in, e.g., M. I. Elinson, "Radio Eng. Electron Phys., 10, 1290 (1965) and other examples will be described later.

The surface-conduction type electron-emitting device utilizes the phenomenon that electrons are emitted by a small-area thin film formed on a substrate by flowing a current parallel through the film surface. The surface-conduction type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 17 is a plan view showing the device by M. Hartwell et al. described above as a typical example of the device structures of these surface-conduction type electron-emitting devices. Referring to FIG. 17, reference numeral 3001 denotes a substrate; and 3004, a conductive thin film made of a metal oxide formed by sputtering. This conductive thin film 3004 has an H-shaped pattern, as shown in FIG. 17. An electron-emitting portion 3005 is formed by performing electrification processing (referred to as forming processing to be described later) with respect to the conductive thin film 3004. An interval L in FIG. 17 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction type electron-emitting devices by M. Hartwell et al. and the like, typically the electron-emitting portion 3005 is formed by performing electrification processing called forming processing for the conductive thin film 3004 before electron emission. In the forming processing, an electron-emitting portion is formed by electrification such that a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin film field emission cathodes with molybdenium cones", J. Appl. Phys., 47, 5248 (1976).

FIG. 18 is a sectional view showing the device by C. A. Spindt et al. described above as a typical example of the FE type device structure. In FIG. 18, reference numeral 3010 denotes a substrate; 3011, an emitter wiring made of a conductive material; 3012, an emitter cone; 3013, an insulating layer; and 3014, a gate electrode. In this device, a voltage is applied between the emitter cone 3012 and gate electrode 3014 to emit electrons from the distal end portion of the emitter cone 3012.

As another FE type device structure, there is an example in which an emitter and gate electrode are arranged on a substrate to be almost parallel to the surface of the substrate, in addition to the multilayered structure of FIG. 18.

A known example of the MIM type electron-emitting devices is described in C. A. Mead, "Operation of Tunnel-Emission Devices", J. Appl. Phys., 32,646 (1961). FIG. 19 shows a typical example of the MIM type device structure. FIG. 19 is a sectional view of the MIM type electron-emitting device. In FIG. 19, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Of cold cathode devices, the above surface-conduction type electron-emitting devices have a simple structure and can be easily manufactured, and thus many devices can be formed on a wide area. As disclosed in Japanese Patent Laid-Open No. 64-31332 filed by the present applicant, a method of arranging and driving a lot of devices has been studied.

Regarding applications of the surface-conduction type electron-emitting devices to, e.g., image forming apparatuses such as an image display apparatus and an image recording apparatus, charge beam sources, and the like have been studied.

Particularly as an application to image display apparatuses, as disclosed in the U.S. Pat. No. 5,066,833 and Japanese Patent Laid-Open Nos. 2-257551 and 4-28137 filed by the present applicant, an image display apparatus using the combination of an surface-conduction type electron-emitting device and a fluorescent substance which emits light upon reception of an electron beam has been studied. This type of image display apparatus using the combination of the surface-conduction type electron-emitting device and the fluorescent substance is expected to exhibit more excellent characteristics than other conventional image display apparatuses. For example, compared with recent popular liquid crystal display apparatuses, the above display apparatus is superior in that it does not require any backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyeret al. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-Open No. 3-55738 filed by the present applicant.

The present inventors have examined cold cathode devices of various materials, various manufacturing methods, and various structures, in addition to the above-mentioned conventional cold cathode devices. Further, the present inventors have made extensive studies on a multi electron beam source having a large number of cold cathode devices, and an image display apparatus using this multi electron beam source.

The present inventors have examined a multi electron beam source having an electrical wiring method shown in, e.g., FIG. 20. That is, a large number of cold cathode devices are two-dimensionally arranged in a matrix to obtain a multi electron beam source, as shown in FIG. 20.

Referring to FIG. 20, reference numeral 4001 denotes a cold cathode device; 4002, a row-direction wiring; and 4003, a column-direction wiring. The row- and column-direction wirings 4002 and 4003 actually have finite electrical resistances, which are represented as wiring resistances 4004 and 4005 in FIG. 20. This wiring method is called a simple matrix wiring method.

For the illustrative convenience, the multi electron beam source is illustrated in a 6×6 matrix, but the size of the matrix is not limited to this. For example, in amulti beam electron source for an image display apparatus, the number of devices enough to perform desired image display are arranged and wired.

In a multi electron beam source constituted by arranging cold cathode devices in a simple matrix, appropriate electrical signals are applied to the row- and column-direction wirings 4002 and 4003 to output a desired electron beam. For example, to drive the cold cathode devices on an arbitrary row in the matrix, a selection voltage Vs is applied to the column-direction wiring 4002 on the row to be selected, and at the same time a non-selection voltage Vns is applied to the row-direction wirings 4002 on an unselected row. In synchronism with this, a driving voltage Ve for outputting an electron beam is applied to the column-direction wiring 4003. According to this method, when voltage drops across the wiring resistances 4004 and 4005 are neglected, a voltage (Ve−Vs) is applied to the cold cathode devices on the selected row, while a voltage (Ve−Vns) is applied to the cold cathode devices on the unselected row. When the voltages Ve, Vs, and Vns are set to appropriate magnitudes, an electron beam having a desired intensity must be output from only the cold cathode device on the selected row. When different driving voltages Ve are applied to respective column-direction wirings, electron beams having different intensities must be output from the respective devices of the selected row. A change in length of time for which the driving voltage Ve is applied necessarily causes a change in length of time for which an electron beam is output.

The multi electron beam source constituted by arranging cold cathode devices in a simple matrix has a variety of applications. For example, when an electrical signal corresponding to image information is appropriately applied, the multi electron beam source can be suitably used as an electron source for an image display apparatus.

The present invention provides a new apparatus and method for forming an image using an electron-emitting device.

More specifically, the conventional apparatus and method suffer the following problems.

Problem (1): The number of devices must be increased to display a high-quality image. Along with this, demands arise for integrating driving circuits for driving many devices and reducing power consumption of the drivers.

Problem (2): The emission/non-emission threshold voltage may slightly vary depending on the accelerating voltage of an emitted electron beam, the panel lot, or the like.

Problem (3): In some cases, the user wants to change the peak luminance in accordance with the ambient brightness at the installation location of the image display apparatus or user tastes.

Further, the user wants to lower the peak luminance in order to suppress power consumption of the image display apparatus.

Problem (4): In some cases, the user wants to set the peak luminance in accordance with a corresponding input image signal when the image display apparatus displays a plurality of image signals such as a TV signal and computer output image signal.

Problem (5): A TV signal is generally received by a receiver using a CRT. The TV signal is output after the gamma characteristic (nonlinear characteristic of luminance signal vs. emission luminance characteristic) of the CRT is corrected (to be referred to as gamma correction hereinafter) on the transmission side in advance.

In other words, when a TV signal is received by a display apparatus using a display device other than the CRT, like the image display apparatus, the display apparatus must adopt an emission characteristic conversion means for adjusting the emission characteristic of the display device to the nonlinear one of the CRT.

Problem (6): To display a color image on the image apparatus, a display panel having three types of fluorescent substances which emit light in red, green, and blue is formed. However, the emission amount of the fluorescent substance which emits light by irradiation of an electron beam varies depending on the type of fluorescent substance in use or the accelerating voltage of an electron beam. Preferable color reproducibility is not always obtained by irradiating the three, red, green, and blue types of fluorescent substances with the same amount of electron beam. In some cases, the user wants to control the irradiation beam amount in accordance with the accelerating voltage or a fluorescent substance in use.

Moreover, the user wants to change the emission color tone of the image display apparatus in accordance with the color tone of the ambient light at the installation location of the image display apparatus or user tastes, or to change the emission color tone in accordance with the type of signal input to the image display apparatus.

In this case, the emission color tone means:

- an emission color when the luminance level of an input signal is as low as almost black;
- an emission color when the luminance level of an input signal is as high as almost the maximum emission luminance; and
- an emission color when an input luminance signal changes from black to white.

Problem (7): When the image display apparatus is constituted using an electron-emitting device, particularly a cold cathode device, and more particularly a surface-conduction type electron-emitting device, like the present invention, an emitted electron beam, i.e., luminance can be modulated by controlling the device application voltage, as described above. However, the electron-emitting device has a rated voltage at which device characteristics degrade or cannot be guaranteed upon application of a device application voltage equal to or higher than a certain voltage value. Hence, this image display requires a protection means for avoiding application of a device voltage equal to or higher than the rated voltage.

SUMMARY OF THE INVENTION

One aspect of the image forming apparatus according to the present invention has the following arrangement.

There is provided an image forming apparatus comprising a plurality of electron-emitting devices arranged in a matrix using pluralities of first and second wirings, a light-emitting substance for emitting light by irradiation of electrons emitted by the electron-emitting devices, a first wiring driving circuit for sequentially selecting the plurality of first wirings and applying, to a selected first wiring, a predetermined potential different from a potential to an unselected first wiring, and a second wiring driving circuit for applying a potential corresponding to an image signal to the plurality of second wirings, characterized in that a potential difference between potentials applied by the first and second wirings to an electron-emitting device which is connected to the first wiring selected by the first wiring driving circuit and is not required to emit light from the light-emitting substance by irradiation of electrons from the electron-emitting device is around a threshold of emission/non-emission of the light-emitting substance by irradiation of electrons from the electron-emitting device.

This arrangement can reduce power consumption. The present inventor has found that power consumption in a circuit for outputting a potential which changes in accordance with an image signal is larger than power consumption in a circuit for sequentially selecting a plurality of wirings (first wirings). This is because the circuit for outputting a potential which changes in accordance with an image signal must output a potential which changes in accordance with, e.g., a desired luminance, whereas the circuit for sequentially selecting a plurality of wirings (first wirings) only performs simple control. (For example, the latter circuit can be formed from a switching circuit such as a transistor when the circuit is switched between selection and non-selection by a binary potential.) Based on this finding, the present inventor has found to reduce power consumption by setting the potential difference between potentials applied by the first and second wirings to an electron-emitting device which is connected to the first wiring selected by the first wiring driver and is not required to emit light from the light-emitting substance by irradiation of electrons from the electron-emitting device, close to the threshold of emission/non-emission of the light-emitting substance by irradiation of electrons from the electron-emitting device. This is because this arrangement can narrow the change range of an output potential from the circuit for outputting a potential which changes in accordance with an image signal.

The threshold can be determined using any one of the followings.

1) The threshold is set to a potential difference when a potential difference is applied to an electron-emitting device by the first and second wirings, and the luminance at the emission position of a light-emitting substance corresponding to the electron-emitting device has a significant value. The luminance can have a significant value when light emitted by the light-emitting substance can be visually recognized with a naked eye in a very dark environment such as a darkroom.

2) The threshold is set to a potential difference when the luminance exceeds the luminance of ambient light. According to "Evaluation Technique for Television Image", Corona-Sha, pp. 83–85, the luminance of the display surface of a receiver by ambient light in home is estimated to be about 2 to 3 cd/m$^2$. The luminance can be measured by a luminance meter.

3) The threshold is set to a different potential having a luminance of 2 cd/m$^2$. The luminance can be measured by a luminance meter.

4) The threshold is determined by a contrast ratio.

Assuming that the peak luminance of the display apparatus is L cd/m$^2$, and the contrast ratio is k, the threshold is set to a potential difference when the luminance reaches L/k cd/m$^2$. According to the reference, a desirable contrast ratio is 30 or more under use conditions in home. Under darkroom conditions free from any influence of external light, adesirable contrast ratio is 100 or more in many cases. For example, if the peak luminance is 300 cd/m$^2$ and the contrast ratio necessary for a darkroom is 200, a potential difference having a luminance of 1.5 cd/m$^2$ is set as a threshold. In the viewpoint of contrast, the potential difference between potentials applied by the first and second wirings to an electron-emitting device not required to emit light is desirably the threshold or less.

The potential difference applied to an electron-emitting device which is connected to the selected first wiring and is not required to emit light from the light-emitting substance by irradiation of electrons from the electron-emitting device is set around the threshold so as to make the difference between the potential difference and threshold fall within 10% of the threshold, preferably 5%, and more preferably 1%. An embodiment of the present invention may set the potential difference larger than the threshold. Also in this case, the difference between the potential difference and threshold is made to fall within 10% of the threshold, preferably 5%, and more preferably 1%.

A potential applied to the electron-emitting device can be obtained by a potential applied to the wiring, the resistance of the wiring, and a current value flowing through the wiring.

The above aspect can be constituted such that the predetermined potential applied to the selected first wiring is lower than a predetermined reference potential by a predetermined value and the potential applied to each second wiring is not less than the reference potential, or the predetermined potential applied to the selected first wiring is higher than a predetermined reference potential by a predetermined value and the potential applied to each second wiring is not more than the reference potential, the first wiring driving circuit applies the predetermined potential to the selected first wiring and the reference potential to the unselected first wiring, and a potential difference between the reference potential and the predetermined potential applied to the selected first wiring is around the threshold. A preferable reference potential is a ground potential.

The arrangement of setting one of potentials within the change range applied to the second wiring that is closest to the potential applied to the selected first wiring to be almost equal to the potential applied to the unselected first wiring is exemplified in, e.g., the first embodiment. In the first embodiment, the reference potential is 0 V, and the potential applied to the selected first wiring (i.e., row wiring) is −11 V. A potential corresponding to an image signal applied to each second wiring (column wiring) falls within the range of 0 V to 4 V.

The first aspect can be constituted such that the image forming apparatus further comprises means for applying a predetermined potential to each second wiring, and a potential difference between the predetermined potential applied to each second wiring and the predetermined potential applied to the selected first wiring is around the threshold. An unstable potential state of the second wiring can be avoided by applying a predetermined potential to a second wiring connected to an electron-emitting device which is connected to the first wiring selected by the first wiring driving circuit and is not required to emit light by irradiation of electrons from the electron-emitting device, and/or a second wiring when no potential corresponding to an image signal is applied.

This aspect can also preferably employ an arrangement in which a potential applied to a second wiring connected to an electron-emitting device which is connected to a first wiring selected by the first wiring driving circuit and is not required to emit light by irradiation of electrons from the electron-emitting device is different from a potential applied to an unselected first wiring. In this case, the potential difference between the potential applied to the second wiring connected to the electron-emitting device which is connected to the selected first wiring and is not required to emit light by irradiation of electrons from the electron-emitting device, and the potential applied to the unselected first wiring does not substantially contribute to the luminance of the light-emitting substance. This potential difference is called an offset voltage. A circuit for applying a potential for this offset voltage is preferably arranged separately from a circuit for controlling a potential applied to the second wiring in accordance with a luminance level.

This arrangement is exemplified in, e.g., the second embodiment. The potential applied to the selected first wiring is −10.5 V, and the predetermined potential applied to each second wiring is 0.5 V. In the second embodiment as well as the first embodiment, a potential corresponding to an image signal is controlled within the range of 0 V to 4 V. Thus, the second wiring receives a potential change from 0.5 V to 4.5 V in addition to the predetermined potential of 0.5 V.

Each aspect may comprise means for adjusting the potential difference between the potentials applied by the first and second wirings to the electron-emitting device which is connected to the first wiring selected by the first wiring driving circuit and is not required to emit light from the light-emitting substance by irradiation of electrons from the electron-emitting device. The potential difference can be adjusted by adjusting the predetermined potential applied to the selected first wiring. In the arrangement of applying the offset voltage, the potential difference can be adjusted by adjusting an offset potential for applying the offset voltage.

Each aspect may comprise means for adjusting a change range of a potential corresponding to an image signal. Since the change range of the potential corresponding to the image signal can be adjusted, the peak luminance can be adjusted. Consequently, the peak luminance can be adjusted in accordance with the ambient brightness of the image forming apparatus or user tastes, or in order to suppress power consumption.

Each aspect may comprise means for determining a type of input image signal and adjusting a change range of a potential corresponding to the image signal on the basis of a determination result. This arrangement allows adjusting the peak luminance in accordance with the type of input image signal such as a TV signal or computer output image signal. Each aspect may comprise means for determining the type of input image signal.

Each aspect may comprise a circuit for detecting a current value flowing through the electron-emitting device and means for adjusting a change range of a potential corresponding an image signal on the basis of a detection result. As the arrangement of detecting a current value flowing through the electron-emitting device, an arrangement of detecting a current emitted by the electron-emitting device is preferably adopted. When, for example, the emitted current value becomes excessively large, the current value can be suppressed.

Each aspect may comprise means for detecting an average luminance level of an input image signal and adjusting a change range of a potential corresponding to the image signal on the basis of a detection result. This arrangement allows adjusting the peak luminance in accordance with the average luminance level. Especially when the average luminance level is high, the peak luminance can be adjusted to a low value, thereby suppressing power consumption. Each aspect may comprise means for detecting an average luminance level of an input image signal.

In each aspect, if any one or a plurality of (1) a potential applied to the selected first wiring, (2) the change range of the potential corresponding to the image signal, and (3) the predetermined potential in the arrangement capable of applying the predetermined potential (including a potential for applying the offset voltage) to each second wiring are adjusted, the total voltage applied to the electron-emitting device may exceed the allowable range to degrade the characteristics of the electron-emitting device or fail to guarantee electron-emitting characteristics. To avoid this, each aspect desirably comprises means for defining the upper limit of a voltage applied to the electron-emitting device. Alternatively, each aspect may comprise means for adjusting the remaining one of (1) to (3) in accordance with a change in any one of (1) to (3).

Each aspect may comprise means for correcting the potential difference between the potentials applied by the first and second wirings to the electron-emitting device on the basis of a relationship between the potential difference and an emission luminance of the light-emitting substance by irradiation of electrons from the electron-emitting device which receives the potential difference. This correction means allows forming a more accurate image. In particular, a normal TV signal is output after the gamma characteristic (nonlinear relationship between a luminance signal and emission luminance) is corrected (to be referred to as gamma correction hereinafter). Therefore, the signal is corrected in accordance with the characteristics of an electron-emitting device or light-emitting substance in use, thereby forming a more accurate image.

To attain multi-color display in each aspect, light-emitting substances are formed for respective colors. Specifically, three, red, green, and blue light-emitting substances are preferably formed to adjust the luminance for the respective colors. In multi-color display, the emission amount of the light-emitting substance which emits light by irradiation of an electron beam changes depending on the type of light-emitting substance in use and the accelerating voltage of an electron beam. A desired display is not always obtained by irradiating the different types of light-emitting substances with the same amount of electron beam. In this case, a potential applied by the second wiring to the electron-emitting device is adjusted in accordance with a color corresponding to each electron-emitting device. More specifically, the change range of a potential applied by the second wiring is adjusted for each color. In the arrangement capable of applying a predetermined potential (including a potential for applying the offset voltage) to each second wiring, the predetermined potential may be adjusted for each color. Alternatively, the above-described correction may be done for each color. While one first wiring is selected, an effective length of a time for applying a potential associated with emission by the second wiring to an electron-emitting device connected to the selected first wiring may be adjusted in accordance with a color corresponding to each electron-emitting device.

In each aspect, a type of input image signal may be determined, and while one first wiring is selected, an effective length of a time for applying a potential associated with emission by the second wiring to an electron-emitting device connected to the selected first wiring may be adjusted on the basis of a determination result.

In each aspect, an average luminance level of an input image signal may be detected, and while one first wiring is selected, an effective length of a time for applying a potential associated with emission by the second wiring to an electron-emitting device connected to the selected first wiring may be adjusted on the basis of a detection result.

In each aspect, a current value flowing through the electron-emitting device may be detected, and while one first wiring is selected, an effective length of a time for applying a potential associated with emission by the second wiring to an electron-emitting device connected to the selected first wiring may be adjusted on the basis of a detection result.

In these arrangements, an effective length of a time for applying a potential associated with emission by the second wiring may be adjusted for each color of the light-emitting substance in accordance with the type of image signal and the average luminance level.

In each aspect, the electron-emitting device may be a cold cathode device. Since the cold cathode device can emit electrons at a lower temperature than a hot cathode device, it does not require any heater. The cold cathode is simpler in structure than the hot cathode device and can shrink in feature size. Even a large number of devices can be arranged at a high density. A high-density arrangement suffers particularly thermal problems, but the cold cathode device is almost free from these problems. In addition, the response speed of the hot cathode device is low because it operates upon heating. To the contrary, the response speed of the cold cathode device is high.

In each aspect, the electron-emitting device may be a surface-conduction type electron-emitting device. The surface-conduction type electron-emitting device is simple in structure and can be easily manufactured.

In each aspect, a potential corresponding to an image signal that is applied to the second wiring may be controlled in accordance with a luminance level.

In each aspect, a change range of a potential applied for luminance gray scale display by the second wiring to an electron-emitting device connected to a first wiring selected by the first wiring driving circuit is preferably narrower than a potential difference between one of potentials within the potential change range that is closest to a potential applied to the selected first wiring, and the potential applied to the selected first wiring.

Another aspect of the image forming apparatus according to the present invention has the following arrangement.

There is provided an image forming apparatus comprising a plurality of electron-emitting devices, a light-emitting substance for emitting light by irradiation of electrons emitted from the electron-emitting devices, first potential application means for sequentially selecting the plurality of electron-emitting devices and applying, to a selected electron-emitting device, a predetermined potential different from a potential applied to an unselected electron-emitting device, and second potential application means for applying a potential corresponding to an image signal to at least a selected electron-emitting device, characterized in that a potential difference between potentials applied by the first and second potential application means to the selected electron-emitting device is around a threshold of emission/non-emission of the light-emitting substance by irradiation of electrons from the electron-emitting device when the light-emitting substance is not required to emit light by irradiation of electrons from the selected electron-emitting device.

Still another aspect of the image forming apparatus according to the present invention has the following arrangement.

There is provided an image forming apparatus comprising a plurality of electron-emitting devices, an light-emitting substance for emitting light by irradiation of electrons emitted from the electron-emitting devices, first potential application means for sequentially selecting the plurality of electron-emitting devices and applying, to a selected electron-emitting device, a predetermined potential different from a potential applied to an unselected electron-emitting device, and second potential application means for applying a potential corresponding to an image signal to at least a selected electron-emitting device for luminance gray scale display, characterized in that the lowest luminance in luminance gray scale display is an light emission level.

The electron-emitting device in each aspect suffices to receive at least two potentials and emit electrons by the potential difference between these potentials. The number of electron-emitting devices is set to a necessary one for forming a desired image. One electron-emitting device preferably corresponds to one pixel.

One aspect of the image forming method according to the present invention has the following steps.

There is provided an image forming method in an image forming apparatus having a plurality of electron-emitting devices arranged in a matrix using pluralities of first and second wirings, a light-emitting substance for emitting light by irradiation of electrons emitted by the electron-emitting devices, a first wiring driving circuit for sequentially selecting the plurality of first wirings and applying, to a selected first wiring, a predetermined potential different from a potential to an unselected first wiring, and a second wiring driving circuit for applying a potential corresponding to an image signal to the plurality of second wirings, characterized in that a potential difference between potentials applied by the first and second wirings to an electron-emitting device which is connected to the first wiring selected by the first wiring driving circuit and is not required to emit light from the light-emitting substance by irradiation of electrons from the electron-emitting device is around a threshold of emission/non-emission of the light-emitting substance by irradiation of electrons from the electron-emitting device, and an image is formed by applying a potential corresponding to an image signal to the plurality of second wirings while sequentially selecting the plurality of first wirings.

Another aspect of the image forming method according to the present invention has the following steps.

There is provided an image forming method in an image forming apparatus having a plurality of electron-emitting devices, a light-emitting substance for emitting light by irradiation of electrons emitted from the electron-emitting devices, first potential application means for sequentially selecting the plurality of electron-emitting devices and applying, to a selected electron-emitting device, a predetermined potential different from a potential applied to an unselected electron-emitting device, and second potential application means for applying a potential corresponding to an image signal to at least a selected electron-emitting device, characterized in that a potential difference between potentials applied by the first and second potential application means to the selected electron-emitting device is around a threshold of emission/non-emission of the light-emitting substance by irradiation of electrons from the electron-emitting device when the light-emitting substance is not required to emit light by irradiation of electrons from the selected electron-emitting device.

Still another aspect of the image forming method according to the present invention has the following steps.

There is provided an image forming method in an image forming apparatus having a plurality of electron-emitting devices, an light-emitting substance for emitting light by irradiation of electrons emitted from the electron-emitting devices, first potential application means for sequentially selecting the plurality of electron-emitting devices and applying, to a selected electron-emitting device, a predetermined potential different from a potential applied to an unselected electron-emitting device, and second potential application means for applying a potential corresponding to an image signal to at least a selected electron-emitting device for luminance gray scale display, characterized in that the lowest luminance in luminance gray scale display is an light emission level.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 10 is a block diagram showing the arrangement of an apparatus according to the third embodiment;

FIG. 32 is a block diagram showing a multi-functional image display apparatus using the image display apparatus according to the embodiment of the present invention.

DETAILED DESCRIPTION OF THE PREFERRED EMBODIMENTS

First Embodiment

Figure 1:
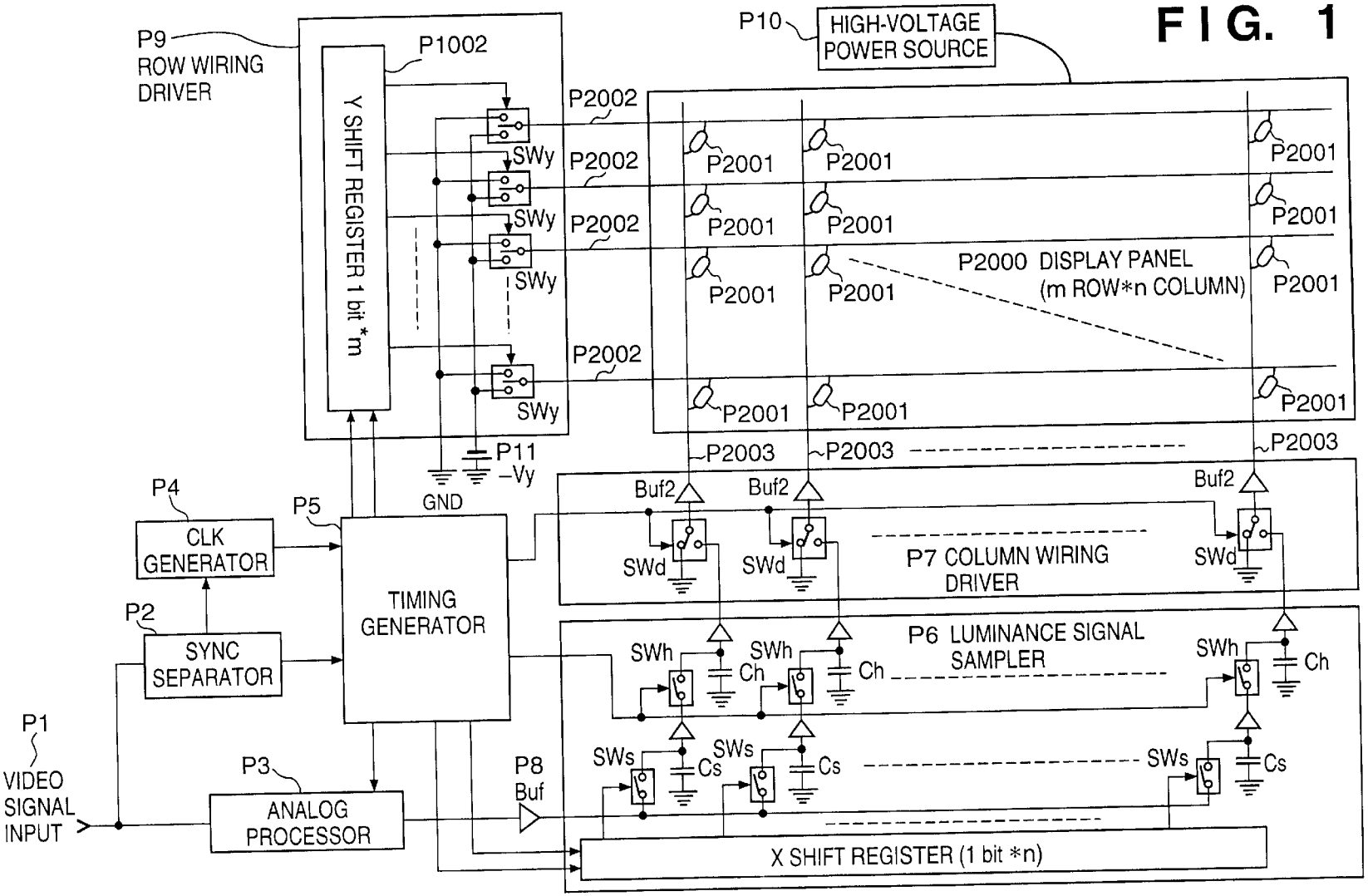
FIG. 1 is a block diagram showing the arrangement of an apparatus according to the first embodiment.

FIG. 1 is a block diagram showing the first embodiment.

Figure 2:
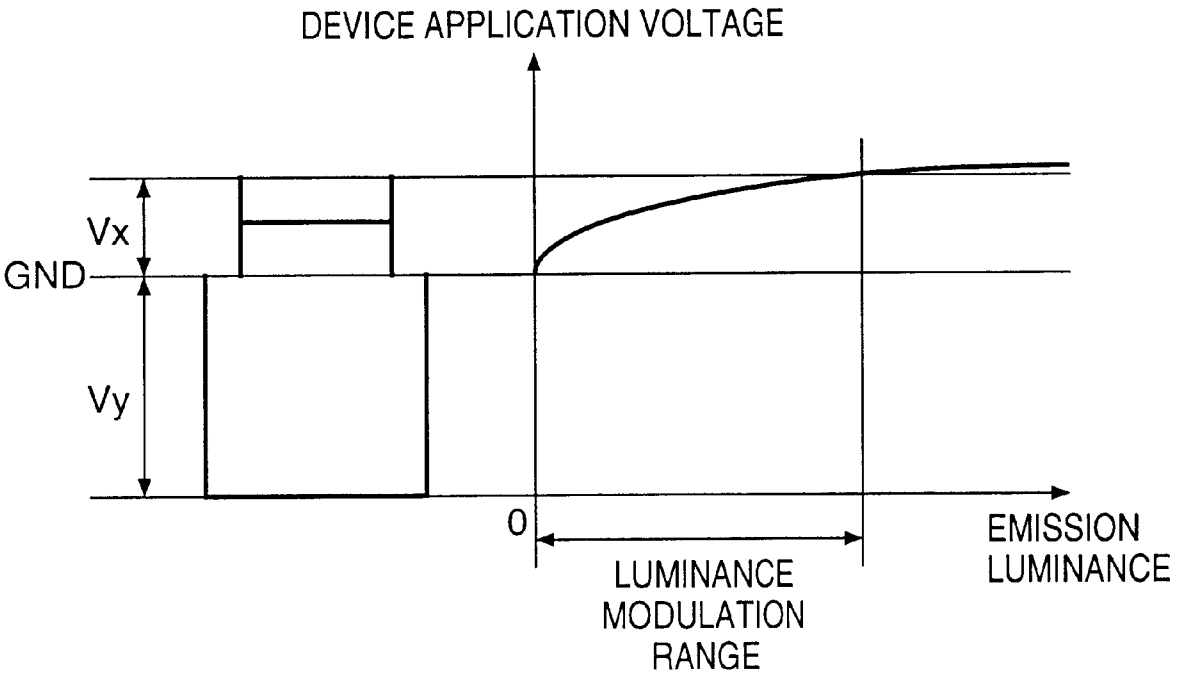
FIG. 2 is a graph showing an example of the driving voltage vs. emission luminance characteristic of a display panel using a surface-conduction type electron-emitting device.

Reference symbol P2000 denotes a display panel on which m*n surface-conduction type electron-emitting devices (P2001) are arranged in a matrix by m vertical row wirings (P2002) and n horizontal column wirings (P2003) and an electron beam emitted by each surface-conduction type electron-emitting device (P2001) is accelerated by a-high voltage applied by a high-voltage power source P10 to irradiate a fluorescent substance (not shown), thereby emitting light. Each pixel has a surface-conduction type electron-emitting device (P2001) driving voltage vs. emission luminance characteristic as shown in FIG. 2.

Figure 4:
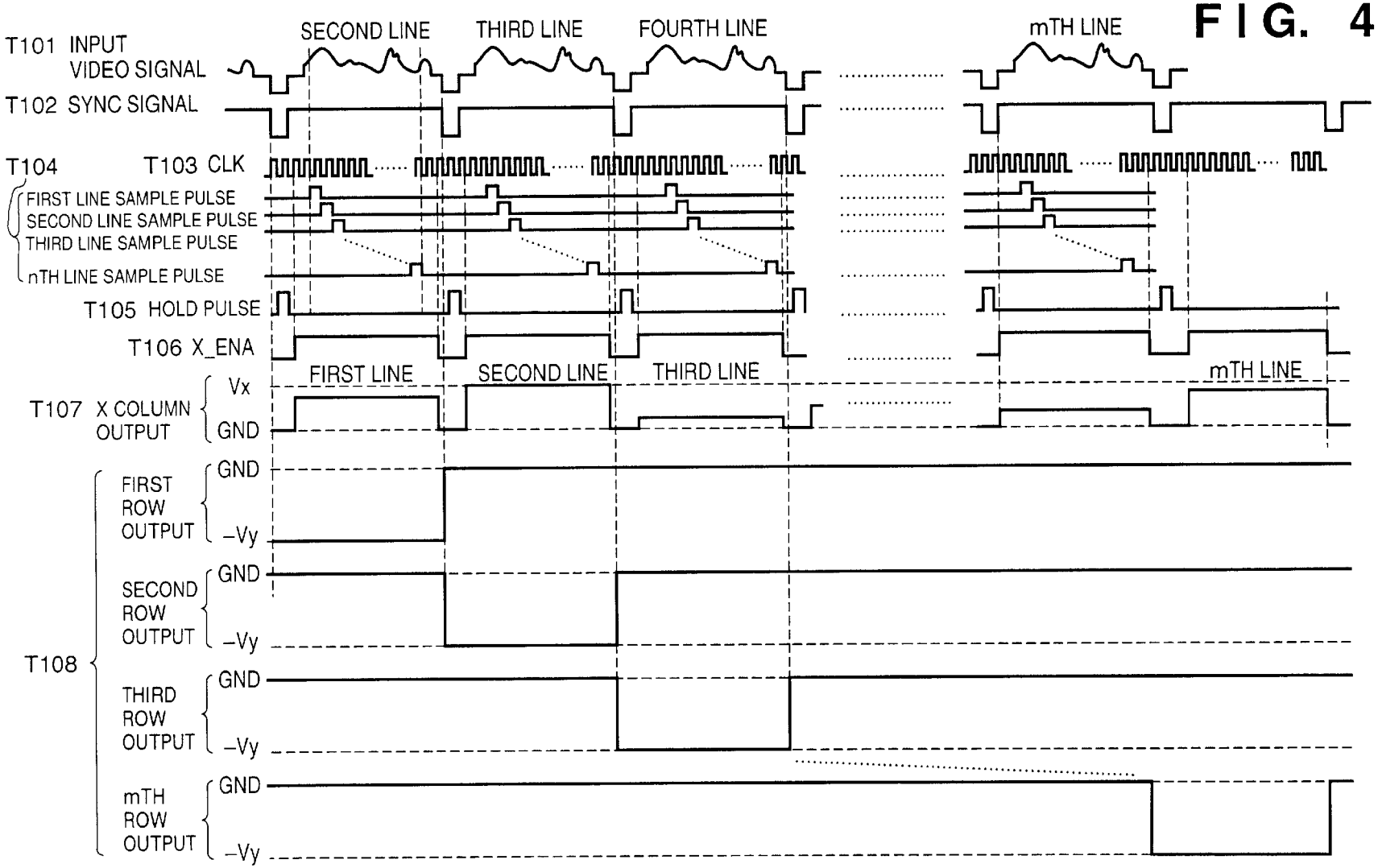
FIG. 4 is a timing chart in the first embodiment.

Reference symbol P1 denotes a video signal input portion which receives a video signal prepared by superposing a luminance signal having an amplitude-modulated luminance level, like a waveform T101 in FIG. 4 (a schematic timing chart of the first embodiment) and a sync signal. If a video signal of another type is input, a signal converter for converting the video signal into the waveform like T101 is arranged on the input portion stage of the video signal input portion P1.

Reference symbol P2 denotes a sync separator for separating the input signal T101 in FIG. 4 into a horizontal sync signal like T102 in FIG. 4 and a vertical sync signal (not shown) and outputting them to a CLK generator P4 and timing generator P5. CLK represents a clock.

An analog processor P3 DC-regenerates an input video signal upon reception of a clamp pulse from the timing generator P5, performs low-pass filter processing for passing only a signal of a necessary band, and performs analog signal processing such as adjustment of the amplitude level of a luminance signal.

The CLK generator P4 is a unit for generating a CLK signal serving as reference, like T103 in FIG. 4. The CLK generator P4 is made up of a VCO as a an oscillation whose oscillation frequency is controlled by, e.g., an external voltage, a frequency divider for dividing an output CLK from the VCO, a phase comparator for comparing the phase of the horizontal sync signal T102 from the sync separator P2, and a PLL circuit for filtering an output from the phase comparator to control the VCO. The CLK generator P4 outputs a stable CLK signal T103 synchronized with an input video signal.

The timing generator P5 receives horizontal and vertical sync signals from the sync separator P2 and a CLK signal from the CLK generator P4, and generates timing signals necessary for the analog processor P3, luminance signal sampler P6, column wiring driver P7, and row wiring driver P9.

Reference symbol P8 denotes a buffer amplifier for outputting an output luminance signal from the analog processor P3 to the luminance signal sampler P6.

The luminance signal sampler P6 samples luminance signals dot-sequentially sent from the buffer amplifier P8 during one horizontal period as luminance data of n pixels in the column direction of the display panel P2000 (The luminance signals are sampled as n luminance data. However, the number of luminance data samples need not always be equal to the number of panel pixels and is determined in accordance with a display specification. In this case, the number of samples is n for descriptive convenience.).

To obtain n luminance sample data every horizontal period, an X shift register made up of, e.g., 1-bit*n flip-flop circuits receives a trigger signal and shift CLK from P5 every horizontal period, and generates n sample pulses obtained by dividing the effective video period of one horizontal period into n, like T104 in FIG. 4. N sample switches Sws arranged on respective column wirings are kept on during the period of the sample pulse from the X shift register, thereby charging luminance signals in sample capacitors Cs.

In this manner, n luminance data are sequentially sampled during the effective video period of one horizontal period, and n hold switches SWh are simultaneously turned on by a hold pulse like T105 in FIG. 4 to transfer the n luminance sample data to hold capacitors Ch during the ineffective video period.

The column wiring driver P7 outputs n parallel luminance data that are made line-sequential every horizontal period in the luminance signal sampler P6 to the column wirings P2003 of the display panel via switches SWd and buffers Buf2 arranged on respective column wirings. Each SWd receives an output enable pulse X_ENA T106 in FIG. 4 from the timing generator P5 to drive a corresponding column wiring with a peak value corresponding to luminance sample data during the period of the output enable pulse X ENA. T107 in FIG. 4 is an example of a driving waveform for an arbitrary one of the n columns.

The row wiring driver P9 is a unit for controlling which row is caused to emit light by a 1/n driving voltage from the column wiring driver P7. The row wiring driver P9 applies an output potential −Vy from a constant voltage source P11 to an emission row, and applies a GND-level potential to a non-emission row. The first embodiment will exemplify the case of sequentially scanning panel row wirings one by one from the first row.

The timing generator P5 outputs a trigger pulse for starting a vertical video display formed based on a vertical sync signal and a shift clock having a horizontal period to a Y shift register made up of, e.g., 1-bit*m flip-flop circuits. Upon reception of them, the Y shift register generates a selection pulse having almost one horizontal period width obtained by dividing the effective video period of one vertical period into m. The selection pulse makes row driving switches SWy arranged on respective row wirings apply a selection pulse having a peak value −Vy from the first row, as represented by T108 in FIG. 4.

As shown in FIG. 2, the voltage vs. emission luminance characteristic of the display panel P2000 using the surface-conduction type device exhibits that the luminance monotonically increases at the threshold voltage or more. In this case, the voltage means the potential difference between the row and column wirings applied to the device. The first embodiment sets the peak value −Vy of the row selection pulse very close to the threshold, and defines the row column wiring potential so as not to emit any light when the column wiring output is 0 and to increase the emission luminance with an increase in column wiring output potential.

As is apparent from FIG. 2, the output potential amplitude of the column wiring driver can be reduced by setting the peak value −Vy of the row selection pulse very close to the threshold.

Figure 3:
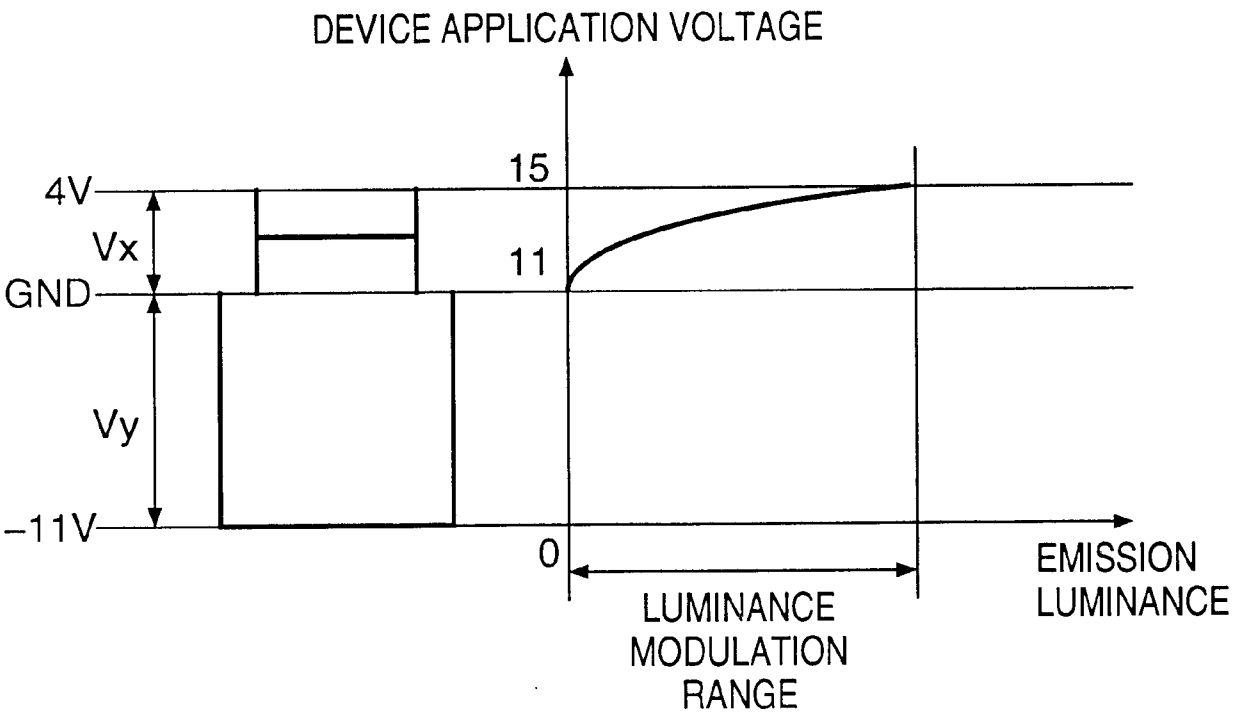
FIG. 3 is a graph showing an example of the driving voltage in the use of the display panel in FIG. 2.

For example, the row-column wiring driving output potential is defined as shown in FIG. 3. In this example, the maximum surface-conduction type device application voltage is 15 V, and the display panel can emit light at a device application voltage falling within the range of about 11 V to 15 V.

A selection pulse of −11 V from GND level is applied to the row wiring, and a driving pulse changing from GND level up to 4 V in accordance with a luminance signal is applied to the column wiring.

The emission characteristic of the display panel changes depending on the manufacturing method of the surface-conduction type device, a high accelerating voltage, a fluorescent substance in use, and the like, but can be optimized depending on application purposes to attain a high-quality display image.

Specifically, the first embodiment can further comprise a means for controlling the output potential of P11 (−Vy voltage generator) to apply a threshold voltage corresponding to the panel.

Second Embodiment

Figure 5:
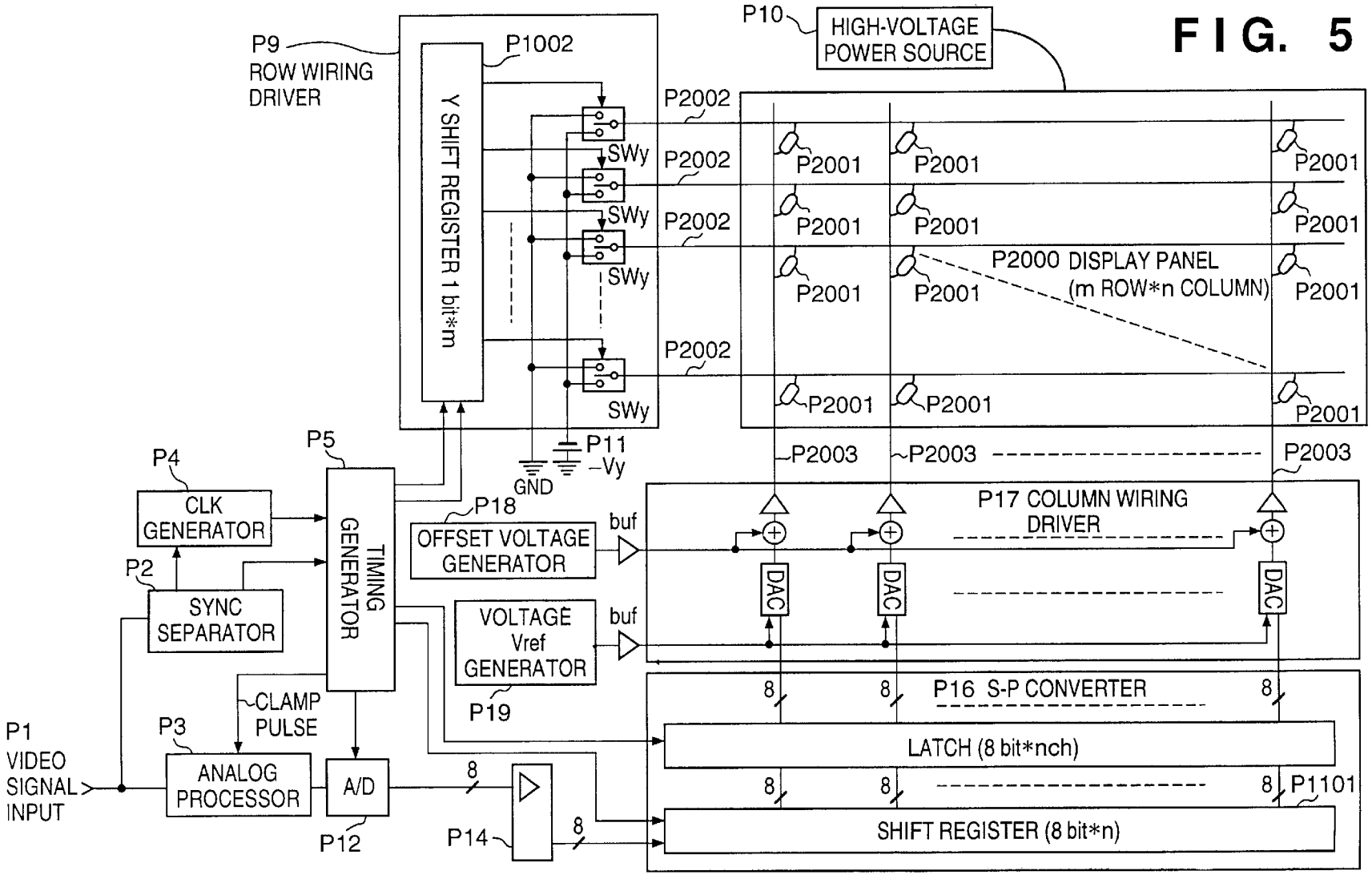
FIG. 5 is a block diagram showing the arrangement of an apparatus according to the second embodiment.

FIG. 5 is a block diagram showing the second embodiment. In FIG. 5, a display panel P2000, video signal input portion P1, sync separator P2, analog processor P3, CLK generator P4, and row wiring driver P9 are the same as in the first embodiment.

A timing generator P5 operates similarly to the first embodiment, and outputs a sample CLK signal to an A/D converter P12 and a shift clock and LD pulse to an S-P converter P16.

The A/D converter P12 receives a sample CLK signal from the timing generator P5 to quantize a luminance signal from the analog processor P3 as n luminance data by a necessary number of levels every horizontal period. The second embodiment exemplifies 8-bit luminance data.

Figure 8:
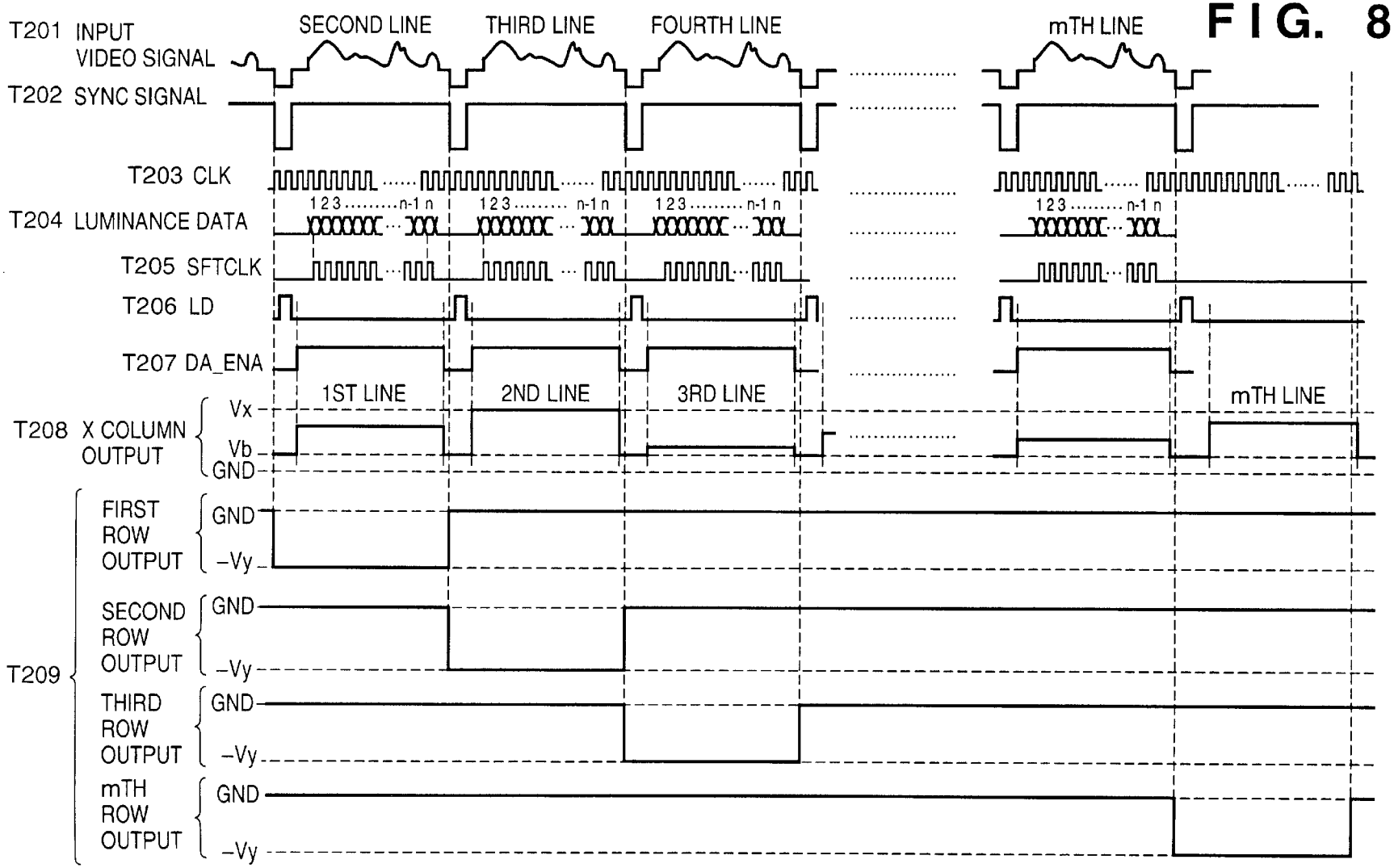
FIG. 8 is a timing chart in the second embodiment.

N temporarily successive serial luminance data, like T204 in FIG. 8, from the A/D converter P12 are output to a shift register in the S-P converter P16 via a buffer P14. The shift register is made up of, e.g., 8-bit*n flip-flop circuits. The n temporarily successive serial luminance data are read from the A/D converter P12 in the shift register in response to shift clocks from P5, like T205 in FIG. 8. The n luminance data read in the shift register are simultaneously transferred to a latch upon reception of an LD pulse T206 in FIG. 8 from P5 during the ineffective period of the shift clock every horizontal period. Then, the n serial luminance data are converted into n parallel data every horizontal period.

Figure 7:
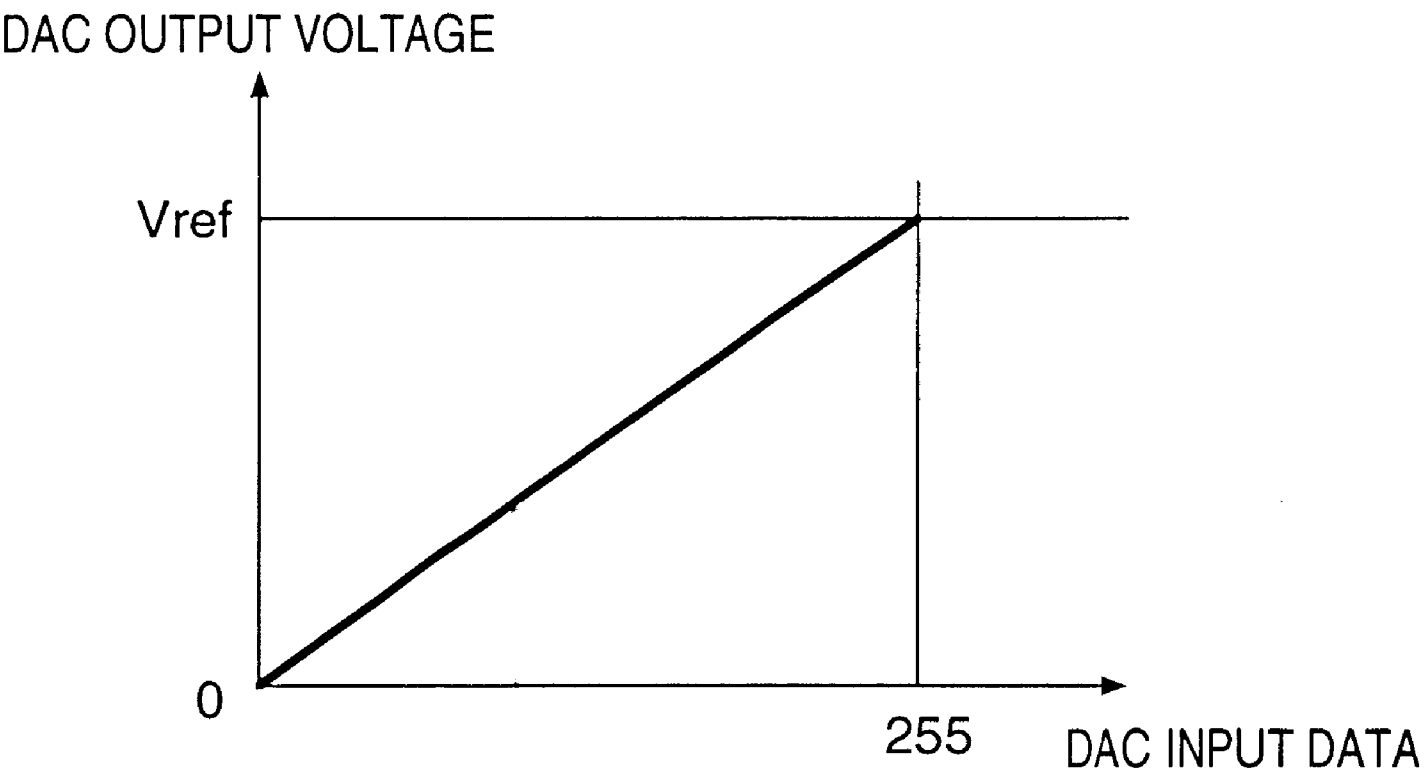
FIG. 7 is a graph showing the output characteristic of a D/A converter means used in the column driving means of the second embodiment.

A column wiring driver P17 comprises DAC means, adders, and buffers for respective column wirings. Each DAC unit receives luminance data from the latch means in P16 and a reference potential from a reference voltage (Vref) generator P19 to exhibit an input data vs. output voltage characteristic as shown in FIG. 7. As is apparent from FIG. 7, the input data vs. output voltage characteristic linearly changes in accordance with input luminance data within the range of GND level to the reference potential Vref. The DAC unit receives an enable signal DA_ENA T207 in FIG. 8 every horizontal period and is controlled not to send any DAC output while reading in luminance data from P16. Each addition means adds an output having a voltage amplitude corresponding to a luminance signal from the DAC unit and an offset potential Vb from an offset voltage generator P18 to drive a corresponding column wiring via the buffer.

Figure 6:
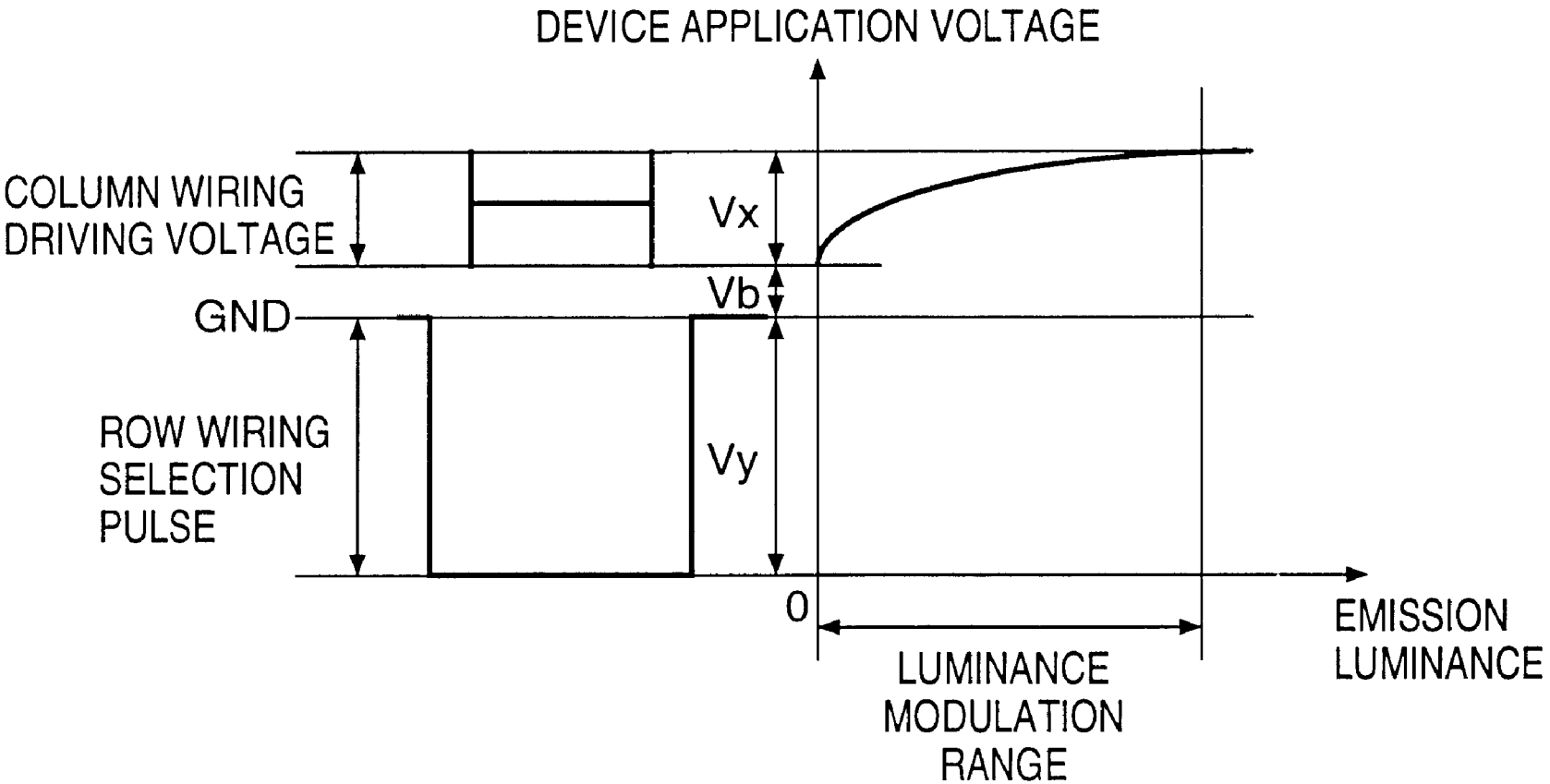
FIG. 6 is a graph showing a setting example of the driving voltage in the second embodiment.

FIG. 6 shows an application example of the panel driving biases of row and column wiring outputs in the second embodiment. As shown in FIG. 6, the sum of the peak value Vy of a row wiring selection pulse and the offset voltage Vb is set to a threshold voltage at which the panel does not emit any light. An output Vx corresponding to luminance data modulates the amplitude between a non-emission state and an emission value of a certain level.

Figure 9:
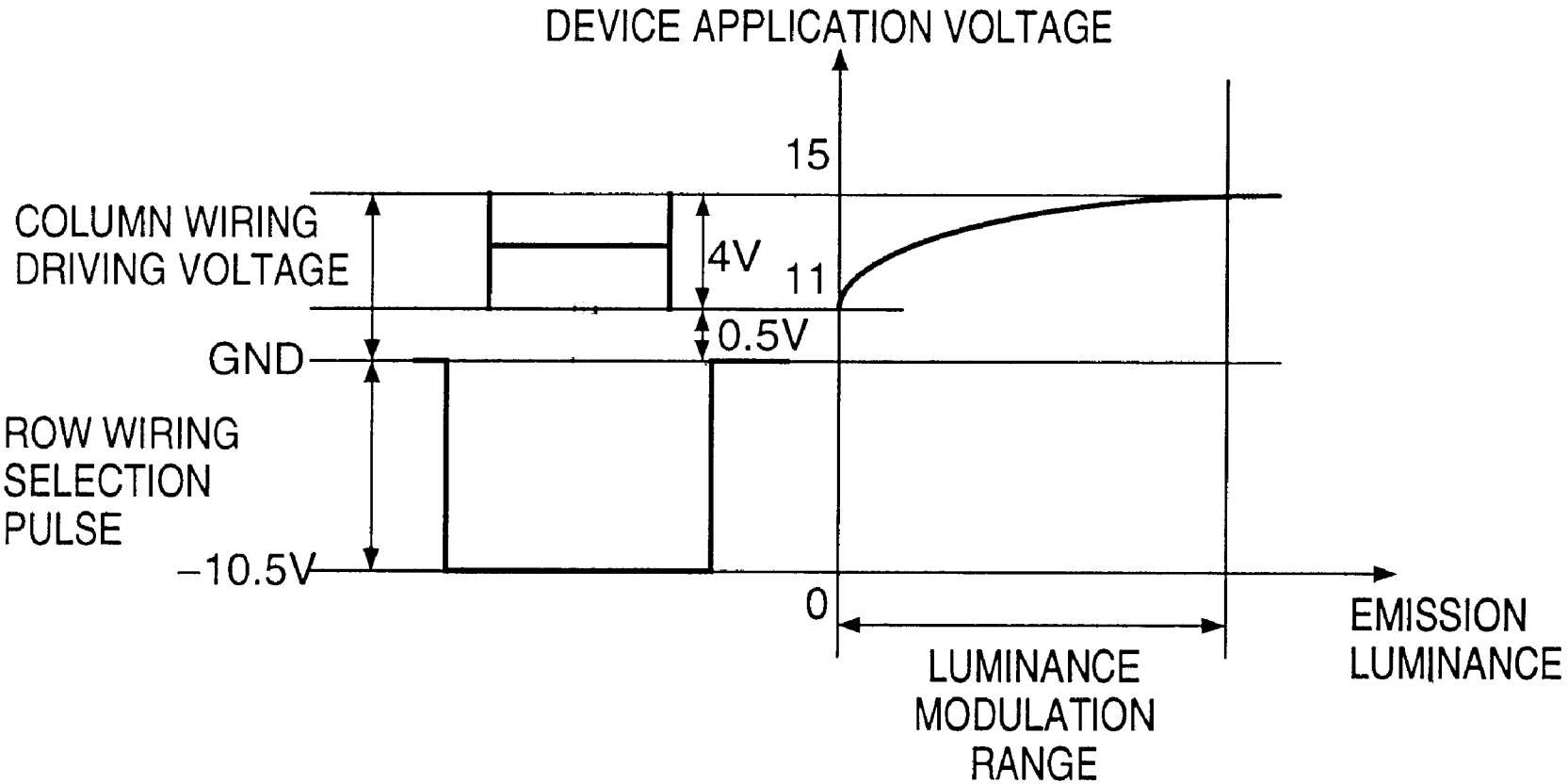
FIG. 9 is a graph showing a detailed setting example of the driving voltage in FIG. 6.

For example, the row-column wiring output is defined as shown in FIG. 9. In this example, the maximum surface-conduction type device application voltage is 15 V, and the display panel can emit light at a device application voltage falling within the range of about 11 V to 15 V.

A selection pulse of −10.5 V from GND level is applied to the row wiring, an offset potential of 0.5 V from GND level is applied to the column wiring, and a driving pulse changing from 0.5 V (offset potential) up to 4.5 V in accordance with a luminance signal is applied (the reference potential Vref of the DAC unit =4 V).

With this bias setting, a high-quality display image can be obtained.

The offset voltage generator P18 in the second embodiment can be equipped with a controller capable of changing the output offset potential. The emission characteristic of the display panel changes depending on the manufacturing method of the surface-conduction type device, a high accelerating voltage, a fluorescent substance in use, and the like, but can cope with a difference in threshold of the panel by this offset potential controller.

Referring to the example in FIG. 9, an offset level of 0.5 V can be changed between 0 V and 1 V.

Even if the user of the image display apparatus wants to emit light of black level (minimum luminance level for image display), the offset potential controller can implement this.

This can also be implemented by a means for controlling the output potential of P11 (−Vy voltage generator).

The reference voltage (Vref) generator P19 in the second embodiment can be equipped with a controller capable of changing the output reference potential Vref. By changing Vref, a device application voltage range corresponding to a luminance signal can be changed to change the peak luminance of the panel.

More specifically, the second embodiment may comprise a brightness adjuster which can be operated by the user of the image display apparatus, thereby controlling the voltage Vref by the brightness adjuster. Thus, the peak luminance can be set in accordance with the ambient brightness at the installation location of the image display apparatus or user tastes.

The second embodiment may further comprise an input video signal average luminance detector to control Vref in accordance with the average level of an input luminance signal (to decrease Vref when the average luminance level of an input video signal is high). If the average luminance level of an input video signal is high to increase power consumption, the peak luminance of the image display apparatus can be suppressed.

Similarly, the second embodiment may comprise a current detector for a high-voltage power source P10 to control Vref in accordance with the current value of the high-voltage power source (to decrease Vref when the average luminance level of an input video signal, i.e., the current value of the high-voltage power source is high). If power consumption increases, the peak luminance of the image display apparatus can be suppressed.

Moreover, the second embodiment may comprise a means for determining the type of input signal and a means for controlling Vref in accordance with the type of input signal. Accordingly, the peak luminance can be suppressed for a short viewing distance for a personal computer image or the like, and increased for a long viewing distance for a TV signal or the like.

Third Embodiment

FIG. 10 shows the third embodiment.

The third embodiment employs a level characteristic correction table P13 in addition to the arrangement of the second embodiment.

Figure 11:
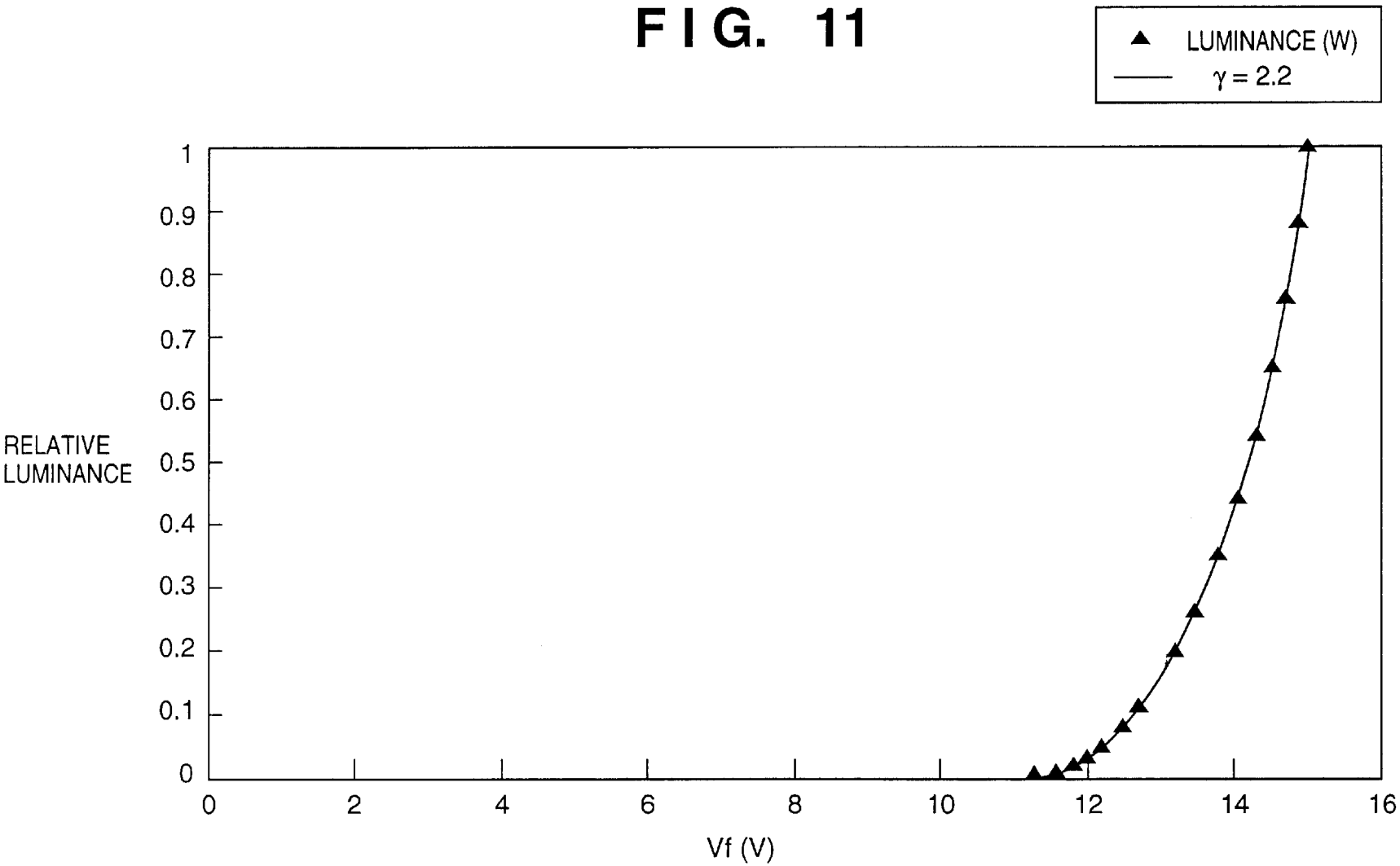
FIG. 11 is a graph showing an example of the driving voltage vs. emission luminance characteristic of a display panel using a surface-conduction type electron-emitting device.

FIG. 11 is a graph obtained by overlapping the driving voltage vs. emission luminance characteristic of a display panel used in the third embodiment and a curve $\gamma=2.2$ power having the emission threshold voltage (11 V) as an origin.

Although the first and second embodiments do not correct the emission level characteristic, a high-quality display image can be obtained without any correction because the image display apparatus has an emission characteristic close to the curve of the general CRT emission characteristic $\gamma=2.2$ power.

The third embodiment is an application example of making the emission characteristic come more strictly close to that of the CRT, thereby obtaining a higher-quality display image.

That is, the level correction table P13 stores characteristic data about the difference between two curves (the driving voltage vs. emission luminance characteristic curve of the display panel according to the third embodiment and the curve $\gamma=2.2$ power). Luminance data from an A/D converter P12 is nonlinearly corrected to make the emission characteristic equal to that of the CRT display.

The third embodiment exemplifies $\gamma=2.2$ power, but the emission characteristic can also be corrected to, e.g., $\gamma=2.0$ power.

Fourth Embodiment

Figure 12:
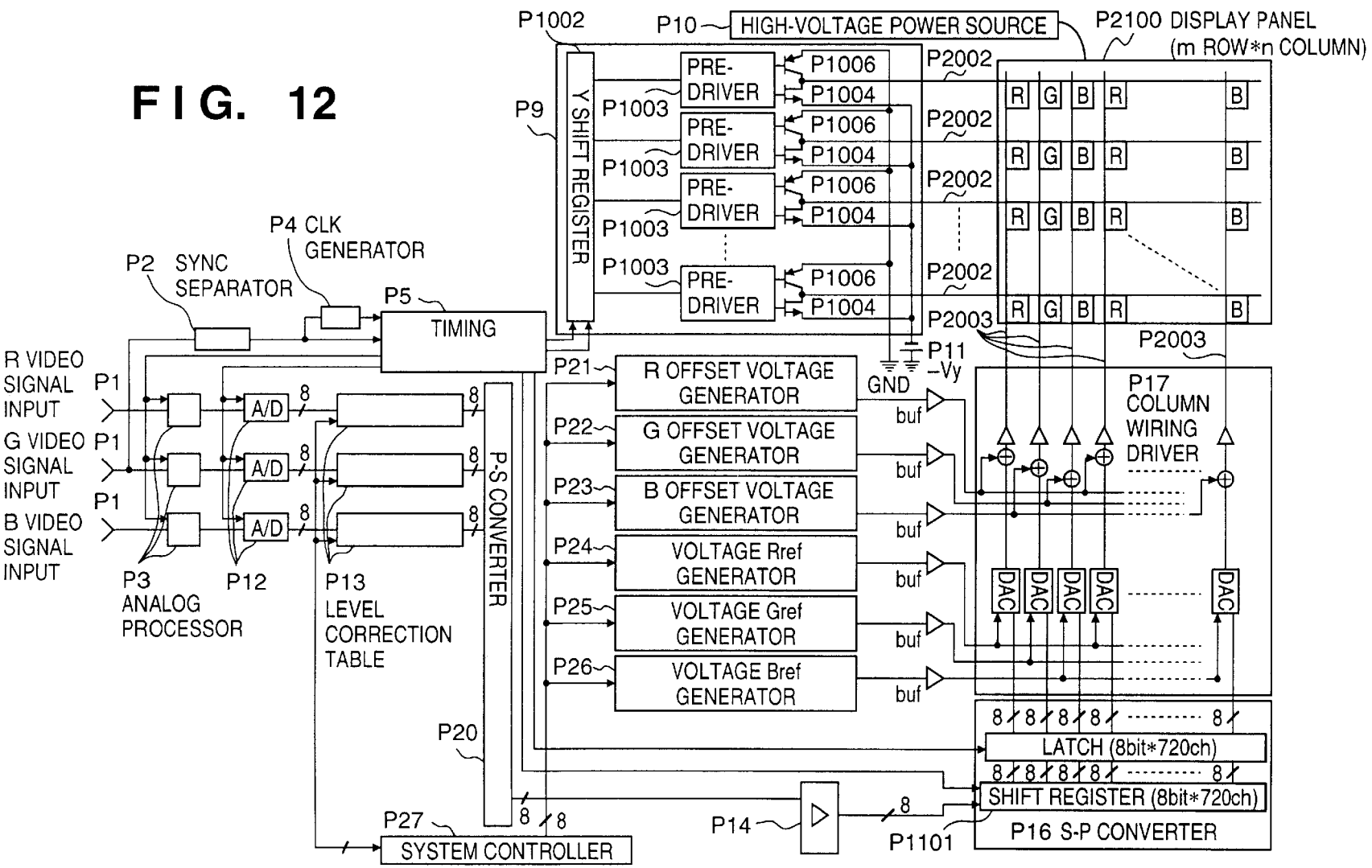
FIG. 12 is a block diagram showing the arrangement of an apparatus according to the fourth embodiment.
Figure 13:
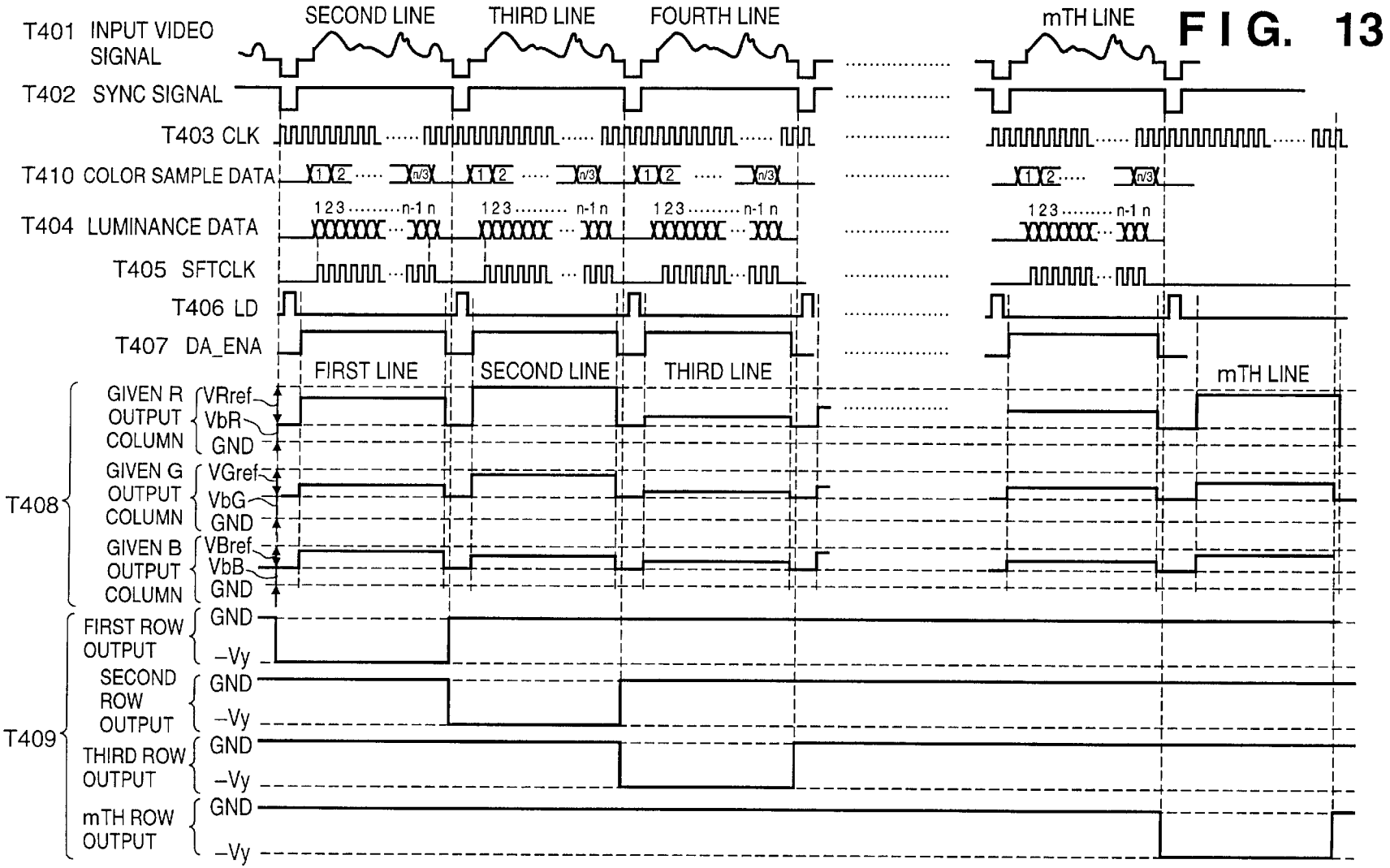
FIG. 13 is a timing chart in the fourth embodiment.

FIG. 12 is block diagram of the fourth embodiment, and FIG. 13 is a timing chart of the fourth embodiment.

Reference symbol P2100 denotes a display panel on which m*n surface-conduction type electron-emitting devices (P2001) are arranged in a matrix by m vertical row wirings (P2002) and n horizontal column wirings (P2003) and an electron beam emitted by each surface-conduction type electron-emitting device (P2001) is accelerated by a high voltage applied by a high-voltage power source to irradiate a fluorescent substance (not shown), thereby emitting light. As shown in FIG. 12, fluorescent substances of three, R, G, and B primary colors are sequentially laid out in stripes. This color layout is merely an example, and another color layout can also be realized with the following arrangement.

Reference symbol P1 denote video signal input portions which are arranged for the three, R, G, and B primary colors and receive video signals each prepared by superposing a luminance signal having an amplitude-modulated luminance level, like a waveform T401 in FIG. 13 (a schematic timing chart of the fourth embodiment) and a sync signal. Even for a video signal of another type, the video signal input portion P can receive it by arranging a signal converter for converting the video signal into the form of the R, G, and B primary signals, like T401, on the input stage of the video signal input portions P1.

A sync separator P2, analog signal processor P3, and CLK generator P4 are the same as in the first embodiment, and a timing generator P5 is the same as in the second embodiment.

An A/D converter P12 arranged for each of the R, G, and B color signals receives a sample CLK signal from the timing generator P5 to quantize a luminance signal from the analog processor P3 as n/3 luminance data by a necessary number of levels every horizontal period. The fourth embodiment exemplifies 8-bit luminance data. The number of samples is n/3 in the fourth embodiment but is not limited to this.

The waveform T401 in FIG. 13 corresponds to output data from the A/D converter P12.

Level correction tables P13 are the same as described in the third embodiment. When the three, R, G, and B colors are similarly corrected, the level correction tables P13 need not be prepared for the respective colors. This can be met by changing level correction for each color when the R, G, and B fluorescent substances have different emission characteristics or the emission color tone is to be changed.

Reference symbol P20 denote a P-S converter for converting n/3 8-bit R, G, and B serial luminance data sent in parallel with each other every horizontal period into n 8-bit serial luminance data every horizontal period. The P-S converter P20 arranges the parallel R, G, and B input data in accordance with the color layout of panel fluorescent substances, and outputs them as n serial luminance data at a triple frequency. The waveform T404 in FIG. 13 corresponds to the serial luminance data.

The n temporarily successive serial luminance data from the P-S converter P20 are output to an S-P converter P16 via a buffer P14, and converted into n parallel data every horizontal period by the same processing as in the second embodiment.

A column wiring driver P17 comprises DAC means, adders, and buffers for respective column wirings, similar to the second embodiment. The column wiring driver P17 of the fourth embodiment is different from that of the second embodiment in that the column wiring driver P17 comprises three, Rref, Gref, and Bref voltage generators P24, P25, and P26 for R, G, and B, and receives reference voltages for the emission colors of respective column wirings. The offset voltage generator also comprises three, R, G, and B offset voltage generators P21, P22, and P23 for R, G, and B, and offset voltages are supplied to the addition means for respective colors.

Since the fourth embodiment comprises the means capable of setting offset potentials for respective emission colors, the emission threshold potentials can be set for the respective colors.

That is, this means allows adjusting the color tone when the luminance level of an input signal is as low as almost black.

Since the fourth embodiment comprises the means capable of setting reference voltages for respective colors, the amplitude of the driving voltage which changes in correspondence with luminance data can be set for respective colors.

That is, this means allows adjusting the color tone when the luminance level of an input signal is as high as almost the maximum emission level.

Similar to the second embodiment, the fourth embodiment may comprise a brightness adjuster which can be operated by the user of the image display apparatus, thereby tracking-controlling the voltages Vref of the respective colors for P24, P25, and P26 by the brightness adjuster. Thus, the peak luminance can be set in accordance with the ambient brightness at the installation location of the image display apparatus or user tastes.

The fourth embodiment may further comprise an input video signal average luminance detector to control Vref of the respective colors for P24, P25, and P26 at the same ratio in accordance with the average level of an input luminance signal (to decrease Vref when the average luminance level of an input video signal is high). If the average luminance level of an input video signal is high to increase power consumption, the peak luminance of the image display apparatus can be suppressed.

Still further, the fourth embodiment may comprise a means for determining the type of input signal and a means for controlling Vref of the respective colors for P24, P25, and P26 at the same ratio in accordance with the type of input signal. Accordingly, the peak luminance is suppressed for a short viewing distance for a personal computer image or the like, and increased for a long viewing distance for a TV signal or the like.

Reference numeral P27 denotes a system controller for controlling output potentials from the R, G, and B offset voltage generators P21, P22, and P23, output potentials from the R, G, and B reference voltage generators P24, P25, and P26, and the level correction table P13. More specifically, the system controller P27 preferably controls signals from the brightness adjuster, input video signal average luminance detector, and input signal type determination means (none of them are shown).

A row wiring driver P9 is the same as in the first embodiment. The row driving switch SWy described in the first embodiment is formed from a pnp transistor (P1006), nmos FET (P1004), and pre-driver P1003 serving as a driving circuit for them. In a row selection state, the FET P1004 is turned on to apply the output voltage −Vy from P11 to a selected row. In a non-selection state, the transistor P1006 is turned on to apply the GND potential. The GND bias is applied to the row wiring in a non-emission state in the fourth embodiment, but a proper bias potential may be applied within the non-emission range.

The surface-conduction type electron-emitting device used in the display panel of the present invention has a rated voltage at which device characteristics degrade or cannot be guaranteed upon application of a device application voltage equal to or higher than a certain voltage value.

If the present invention adopts the arrangement capable of freely changing the offset voltage and reference voltage, the device application voltage may exceed the rated voltage as if the offset voltage and reference voltage were maximized.

The system controller P27 can comprise the protection function against this. For example, when the system controller P27 receives a request of increasing the offset voltage, it increases the offset voltage with reference to the current reference voltage setting value so as not to exceed the rated voltage, and if the offset voltage is about to exceed the rated voltage, decreases the reference voltage, thereby protecting device characteristics.

Figure 16:
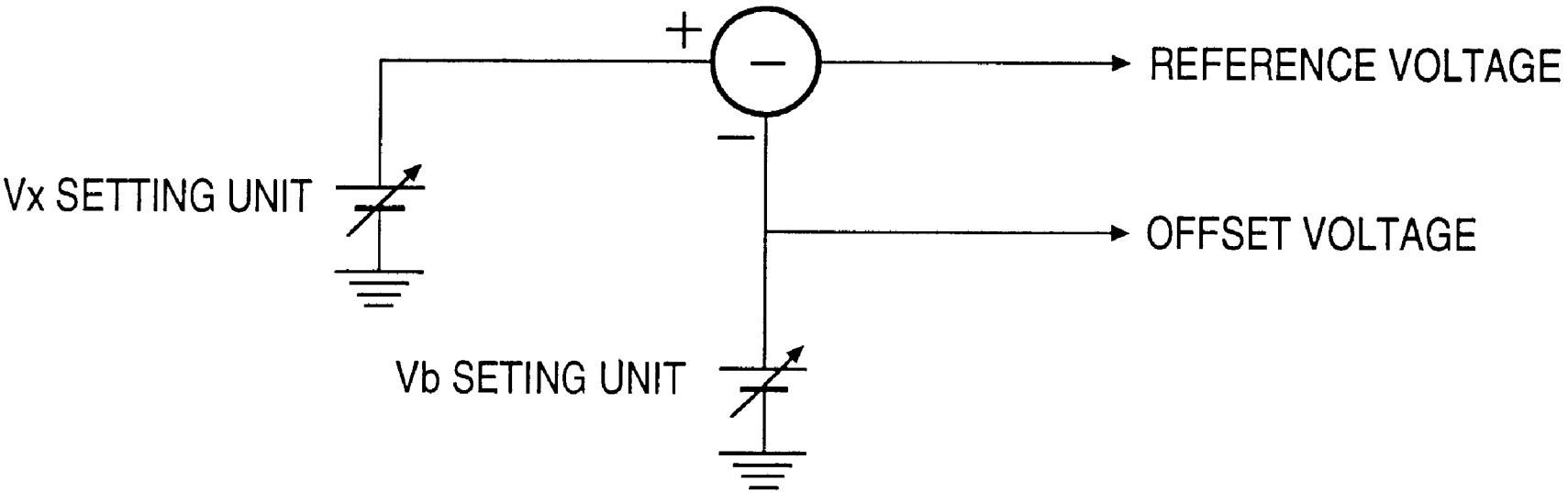
FIG. 16 is a circuit diagram showing another example of a protection arrangement for the rated voltage in the fourth embodiment.
Figure 17:
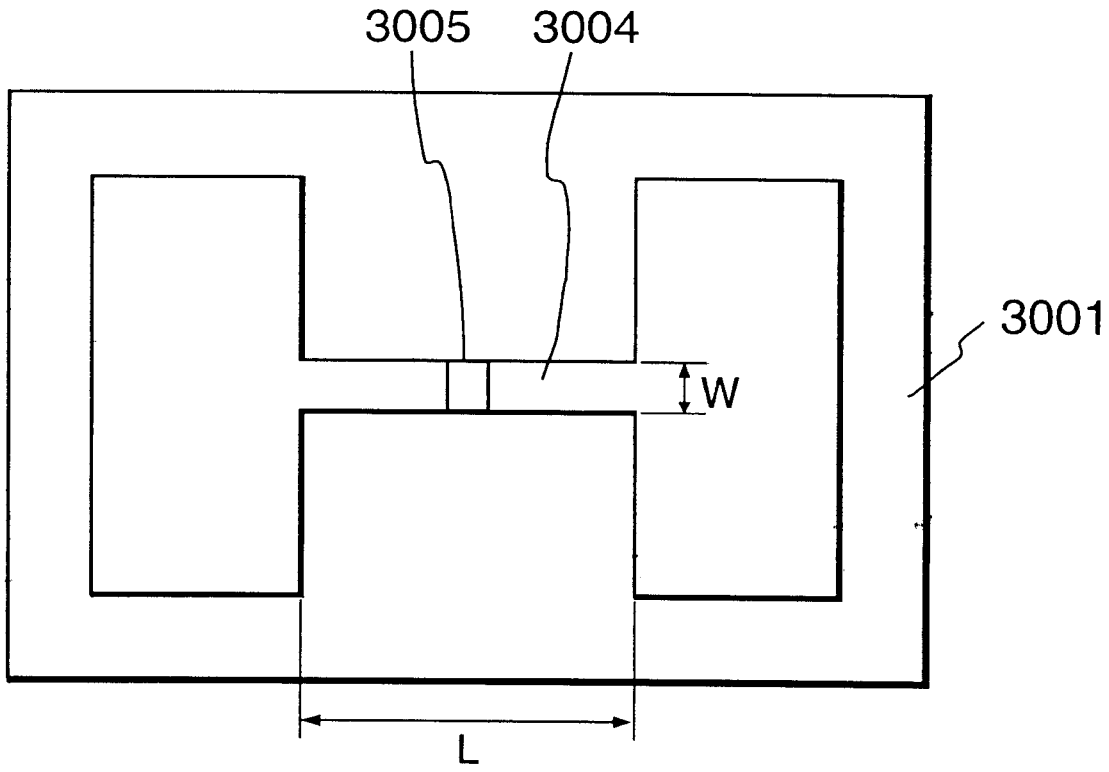
FIG. 17 is a plan view showing an example of the electron-emitting device.
Figure 18:
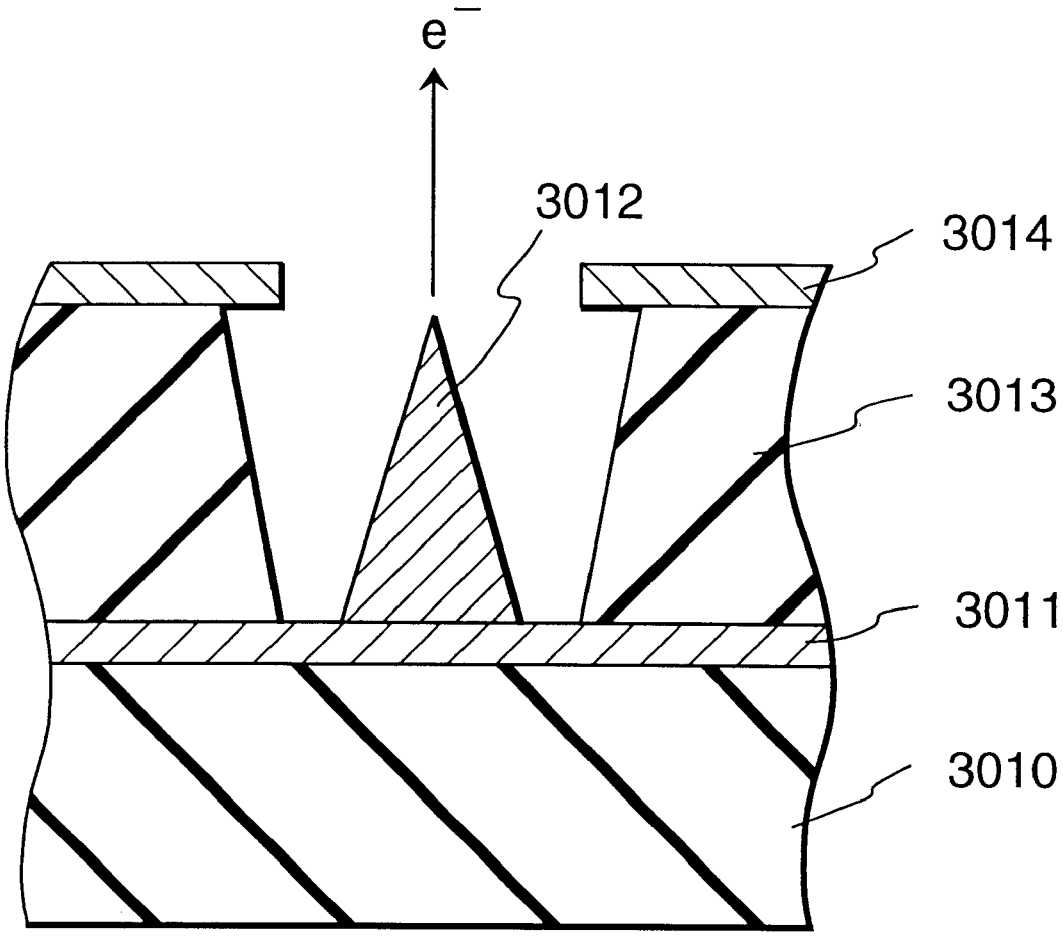
FIG. 18 is a sectional view showing another example of the electron-emitting device.
Figure 19:
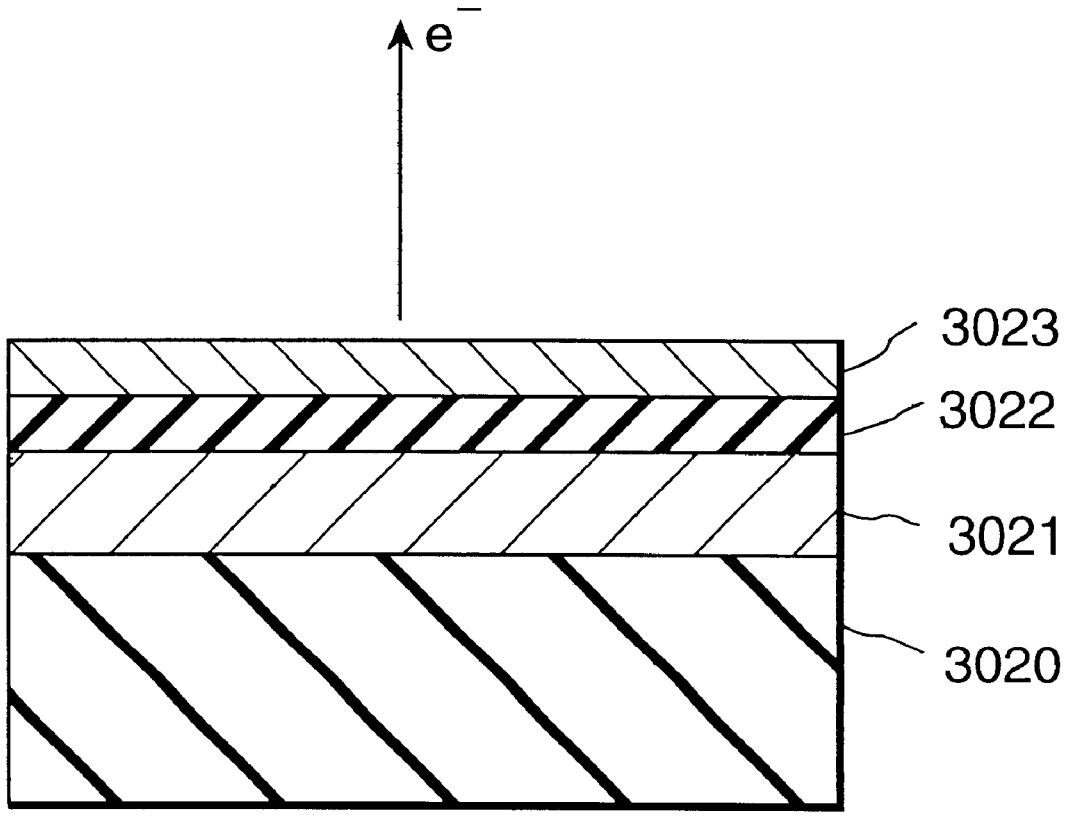
FIG. 19 is a sectional view showing still another example of the electron-emitting device.
Figure 20:
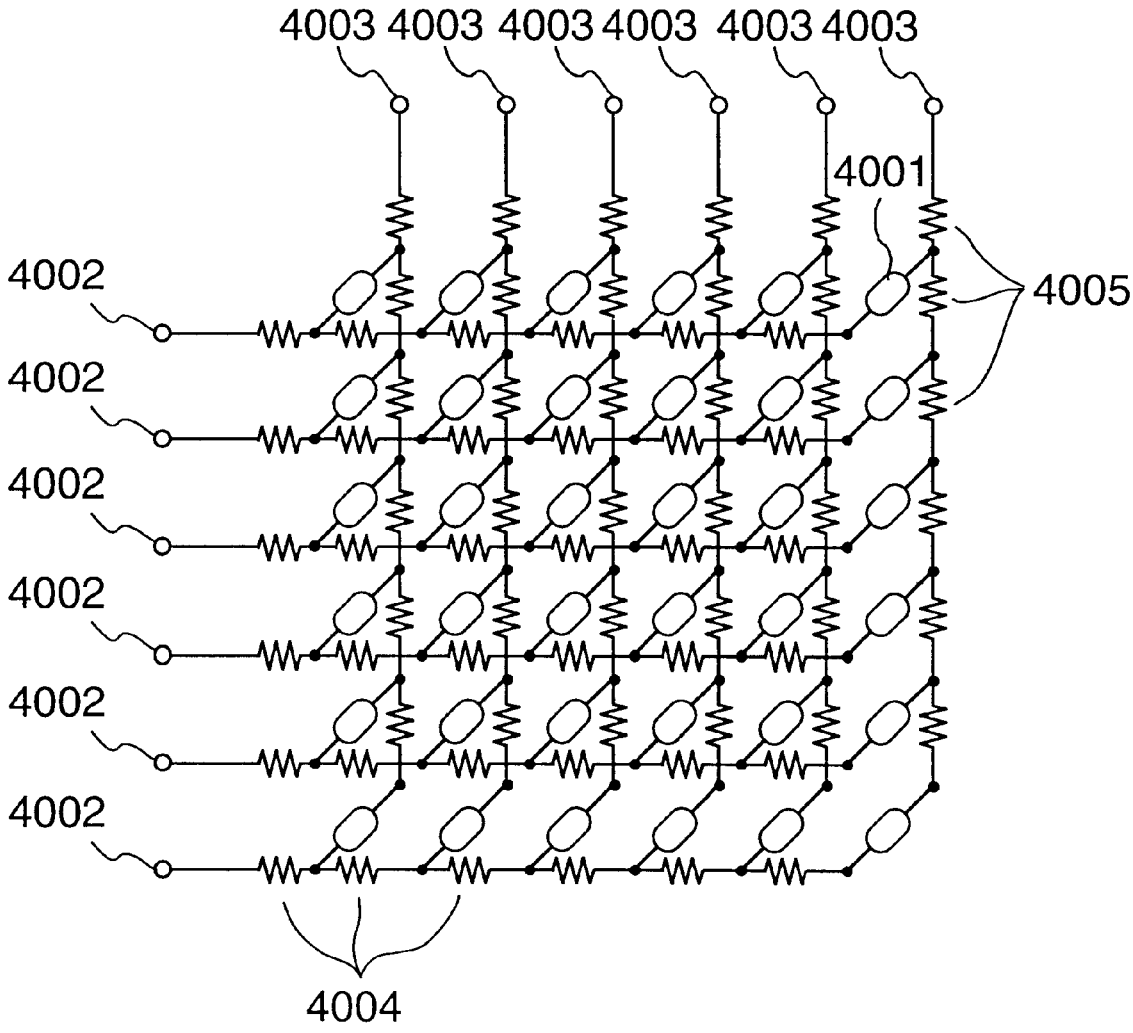
FIG. 20 is a circuit diagram showing an example of the matrix layout of electron-emitting devices.

The protection control for preventing the device application voltage from exceeding the rated voltage is implemented by the system controller P27, but can also be implemented by another means like the one shown in FIG. 16. FIG. 16 shows an arrangement example of a protection circuit for preventing the device application voltage from exceeding the rated voltage of a column wiring driver for a given color. The protection control of decreasing the reference potential as the offset potential increases is realized by determining the reference voltage by the arithmetic result (the difference in FIG. 16) of the amplitude adjustment voltage and offset voltage.

If the offset voltage changes, the nonlinear characteristic of an emission amount corresponding to a luminance signal may shift. In this case, the system controller P27 can adaptively control data in the level correction table P13 to maintain a preferable emission characteristic.

Fifth Embodiment

Figure 14:
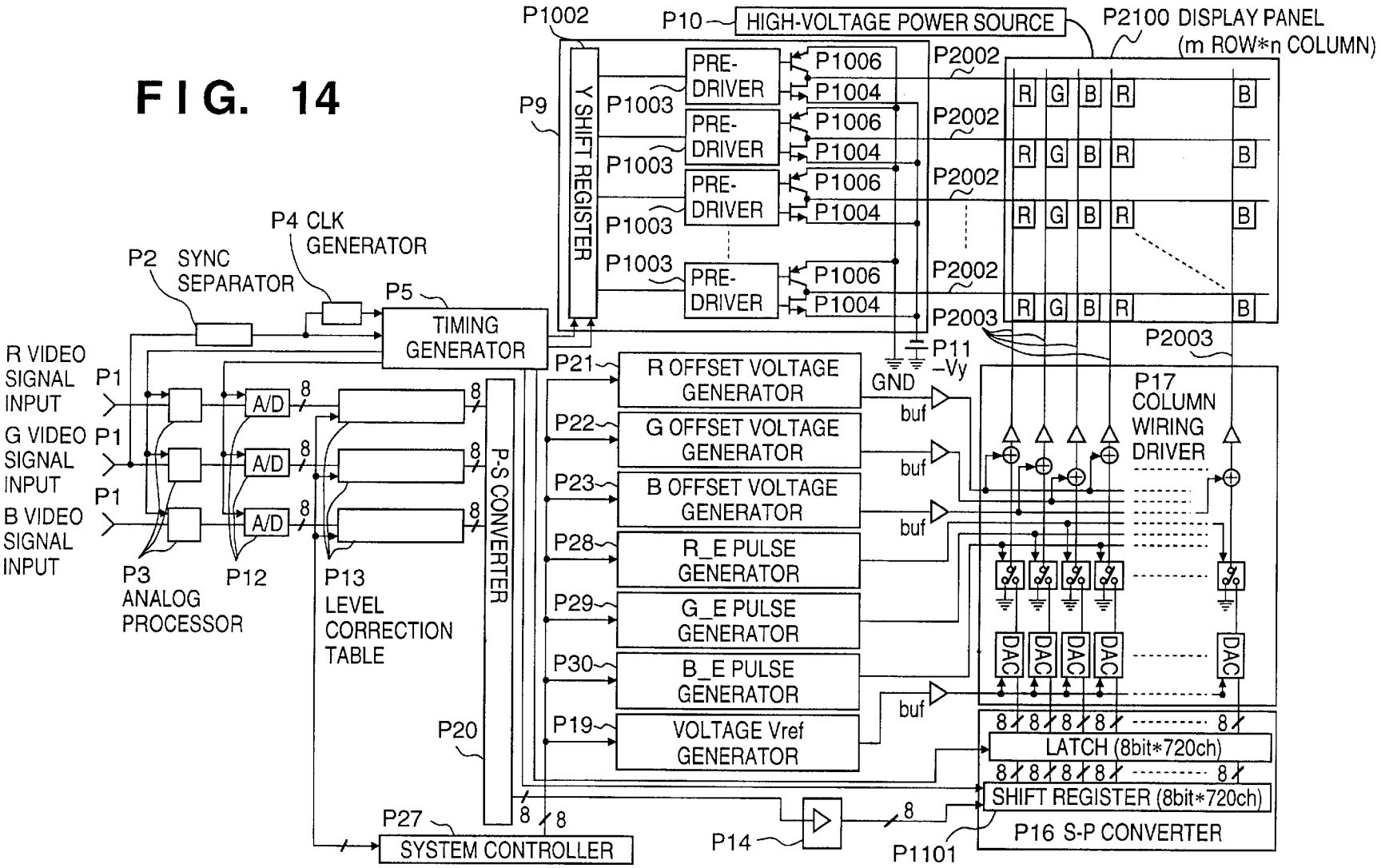
FIG. 14 is a block diagram showing the arrangement of an apparatus according to the fifth embodiment.
Figure 15:
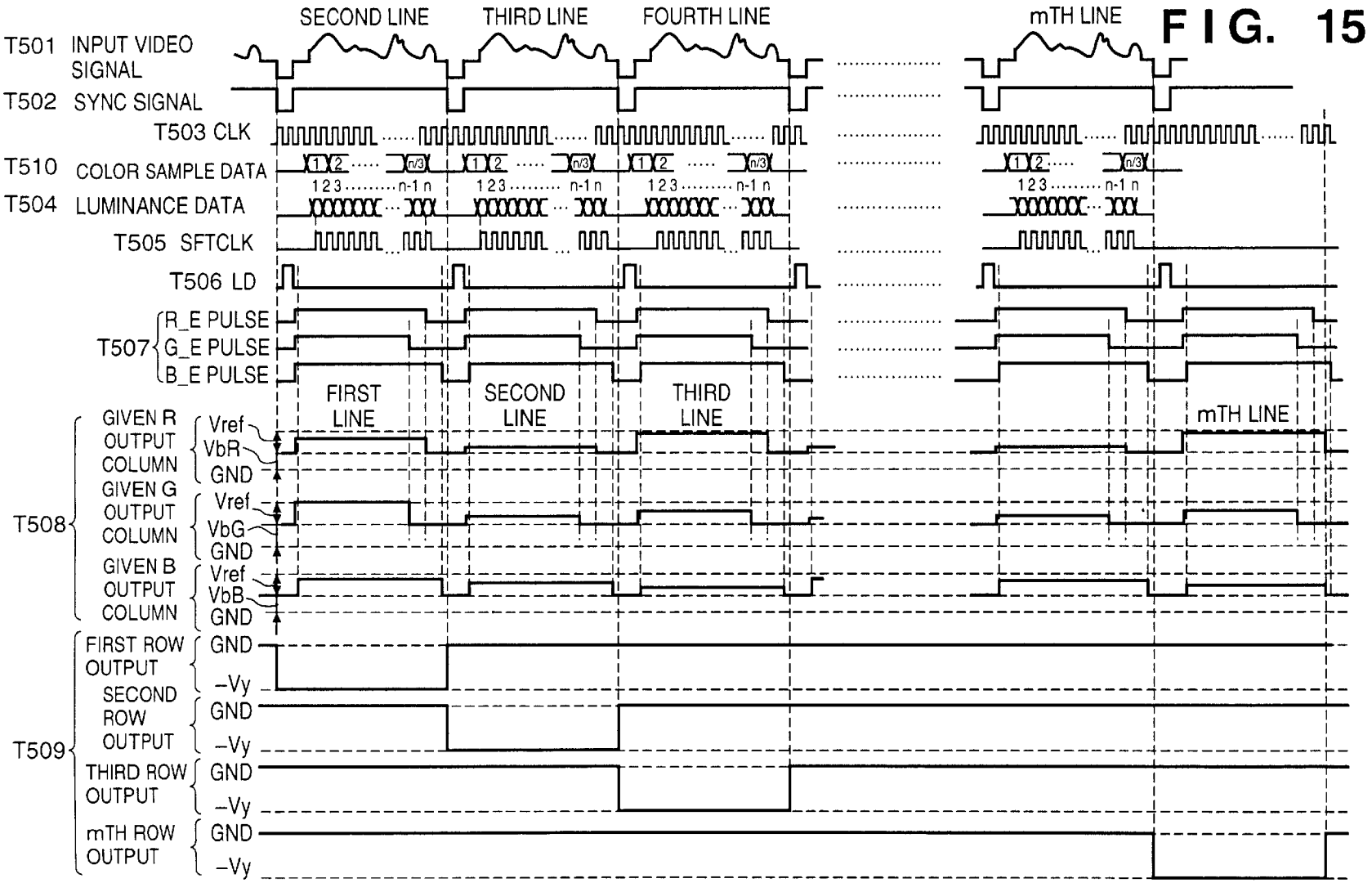
FIG. 15 is a timing chart in the fifth embodiment.

FIG. 14 is block diagram of the fifth embodiment, and FIG. 15 is a timing chart of the fifth embodiment.

The fifth embodiment is different from the fourth embodiment in that the reference voltage generators arranged for R, G, and B are combined into one reference voltage generator P19, an R_E pulse generator P28, G_E pulse generator P29, and B_E pulse generator P30 are arranged, and a column wiring driver P17 incorporates SW means which receive pulse signals from P28 to P30 to determine whether DAC output voltages are output to addition means.

Pulse signals from P28 to P30 are supplied to column wirings of corresponding colors, and the time width for applying the column wiring output voltage to the surface-conduction type electron-emitting device is determined in units of the respective R, G, and B emission colors.

Each of the pulse generators P28 to P30 comprises a counter means for counting, e.g., the number of CLKs T503 in FIG. 15, and a means for comparing pulse count data (representing the pulse width) set by a system controller P27, the counter value of the counter means, and pulse count data. Every horizontal period, the pulse generator outputs a pulse signal having a time width required for the counter value and pulse data to coincide with each other after the start of counting.

In this way, the system controller P27 can control, individually or simultaneously for R, G, and B, the pulse width of a voltage pulse having an amplitude corresponding to a luminance signal output from the column wiring.

Similar to the second embodiment, the fifth embodiment may comprise a brightness adjuster which can be operated by the user of the image display apparatus, thereby tracking-controlling the output pulse widths of P28 to P30 by the brightness adjuster. Thus, the peak luminance can be set in accordance with the ambient brightness at the installation location of the image display apparatus or user tastes.

The fifth embodiment may further comprise an input video signal average luminance detector to control the output pulse widths of P28 to P30 at the same ratio in accordance with the average level of an input luminance signal (to shorten the pulse widths when the average luminance level of an input video signal is high). If the average luminance level of an input video signal is high to increase power consumption, the peak luminance of the image display apparatus can be suppressed.

Similarly, the fifth embodiment may comprise a current detector for a high-voltage power source P10 to control the output pulse widths of P28 to P30 at the same ratio in accordance with the current value of the high-voltage power source (to shorten the pulse width when the average luminance level of an input video signal, i.e., the current value of the high-voltage power source is high). If power consumption increases, the peak luminance of the image display apparatus can be suppressed.

In addition, the fifth embodiment may comprise a means for determining the type of input signal and a means for controlling the output pulse widths of P28 to P30 at the same ratio in accordance with the type of input signal. Accordingly, the peak luminance can be suppressed for a short viewing distance for a personal computer image or the like, and increased for a long viewing distance for a TV signal or the like.

Arrangement Example of Peripheral and Whole Circuits (Arrangement and Manufacturing Method of Display Panel)

The arrangement and manufacturing method of the display panel of the image display apparatus according to the present invention will be exemplified.

Figure 21:
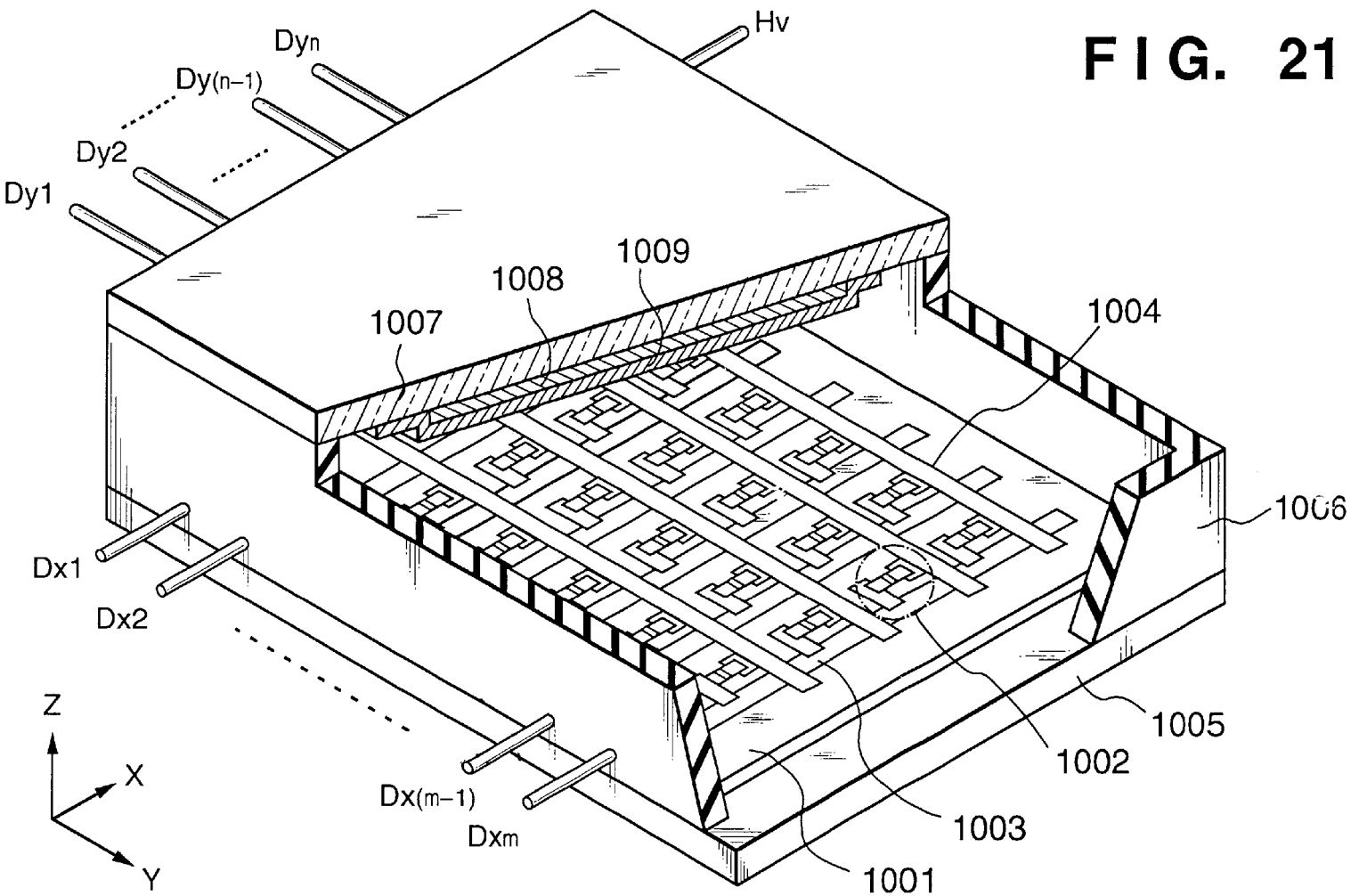
FIG. 21 is a partially cutaway perspective view showing the display panel of an image display apparatus according to the embodiment of the present invention.

FIG. 21 is a partially cutaway perspective view of the display panel used in the embodiment showing the internal structure of the panel.

In FIG. 21, reference numeral 1005 denotes a rear plate; 1006, a side wall; and 1007, a face plate. These parts 1005 to 1007 constitute an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed thereon, on which N×M cold cathode devices 1002 are formed (N, M=positive integer equal to 2 or more, properly set in accordance with a desired number of display pixels. For example, in a display apparatus for high-resolution television display, preferably N=3,000 or more, M=1,000 or more. In this embodiment, N=3,072 or more, M=1,024.) The N×M cold cathode devices are arranged in a simple matrix with M row-direction wirings 1003 and N column-direction wirings 1004. The portion constituted by the components denoted by references 1001 to 1004 will be referred to as a multi electron-beam source. The manufacturing method and structure of the multi electron-beam source will be described in detail later.

In this embodiment, the substrate 1001 of the multi electron-beam source is fixed to the rear plate 1005 of the airtight container. If, however, the substrate 1001 of the multi electron-beam source has sufficient strength, the substrate 1001 of the multi electron-beam source may also serve as the rear plate of the airtight container.

Figure 22A:
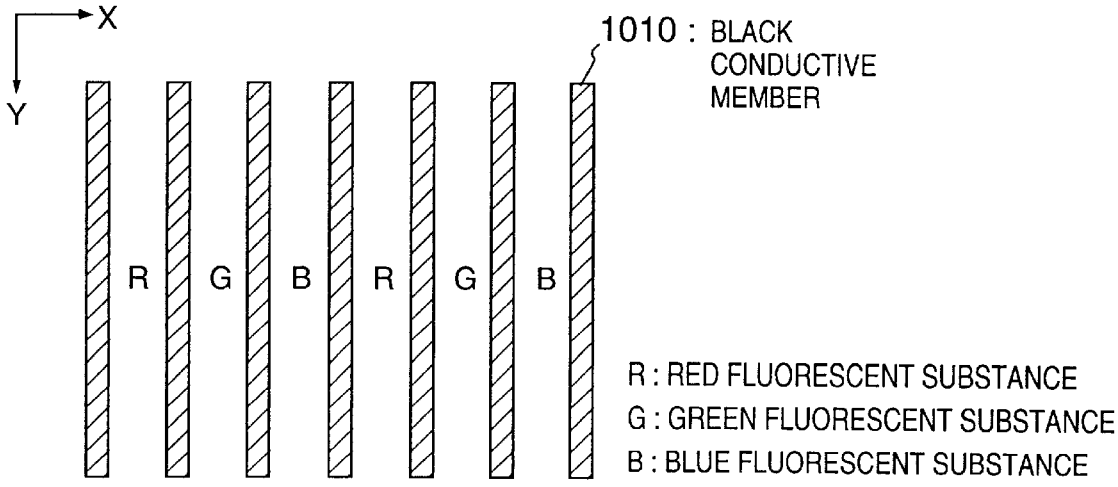
FIGS. 22A and 22B are plan views showing examples of the layout of fluorescent substances on the face plate of the display panel.

A fluorescent film 1008 is formed on the lower surface of the face plate 1007. As this embodiment is a color display apparatus, the fluorescent film 1008 is coated with red, green, and blue fluorescent substances, i.e., three primary color fluorescent substances used in the CRT field. As shown in FIG. 22A, the respective color fluorescent substances are formed into a striped structure, and black conductive members 1010 are provided between the stripes of the fluorescent substances. The purpose of providing the black conductive members 1010 is to prevent display color misregistration even if the electron-beam irradiation position is shifted to some extent, to prevent degradation of display contrast by shutting off reflection of external light, to prevent the charge-up of the fluorescent film by the electron beam, and the like. As a material for the black conductive members 1010, graphite is used as a main component, but other materials may be used so long as the above purpose is attained.

Figure 22B:
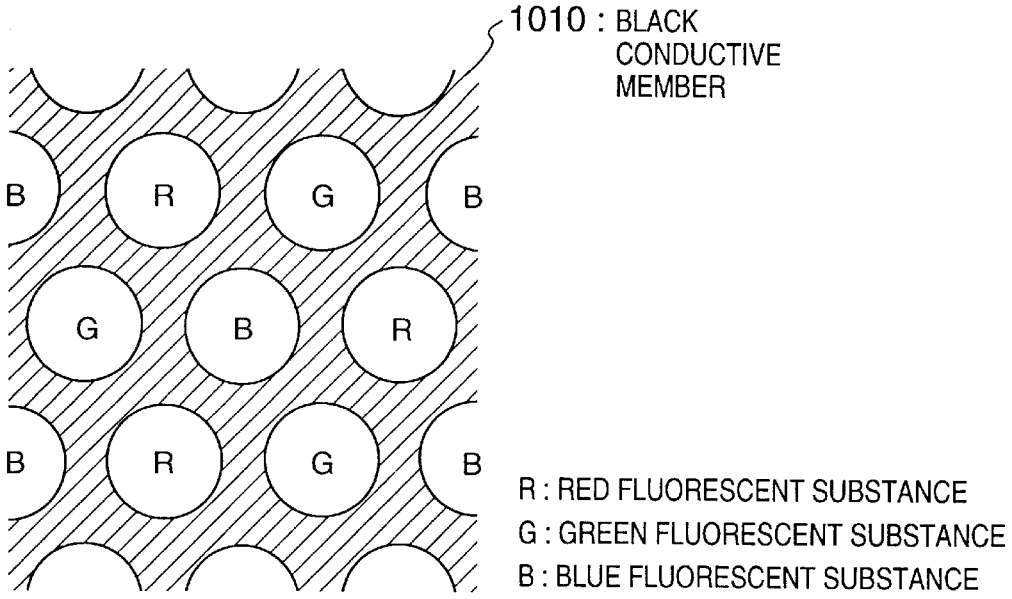

Further, the three primary colors of the fluorescent film is not limited to the stripes as shown in FIG. 22A. For example, delta arrangement as shown in FIG. 22B or any other arrangement may be employed.

Note that when a monochrome display panel is formed, a single-color fluorescent substance may be applied to the fluorescent film 1008, and the black conductive member may be omitted.

Furthermore, a metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron-beam accelerating voltage, to be used as a conductive path for electrons which excited the fluorescent film 1008, and the like. The metal back 1009 is formed by forming the fluorescent film 1008 on the face plate substrate 1007, smoothing the front surface of the fluorescent film, and depositing Al thereon by vacuum deposition. Note that when fluorescent substances for a low voltage is used for the fluorescent film 1008, the metal back 1009 is not used.

Furthermore, for application of an accelerating voltage or improvement of the conductivity of the fluorescent film, transparent electrodes made of, e.g., ITO may be provided between the face plate substrate 1007 and the fluorescent film 1008, although such electrodes are not used in this embodiment.

Dx1 to Dxm, Dy1 to Dyn, and Hv are electric connection terminals for an airtight structure provided to electrically connect the display panel to an electric circuit (not shown) Dx1 to Dxm are electrically connected to the row-direction wirings 1003 of the multi electron-beam source; Dy1 to Dyn, to the column-direction wirings 1004 of the multi electron-beam source; and Hv, to the metal back 1009 of the face plate.

To evacuate the airtight container, after forming the airtight container, an exhaust pipe and vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by heating or RF heating. The suction effect of the getter film maintains a vacuum of $1\times10^{-5}$ or $1\times10^{-7}$ Torr in the container.

The basic arrangement and manufacturing method of the display panel according to the embodiment of the present invention have been briefly described above.

A method of manufacturing the multi electron-beam source used in the display panel of this embodiment will be described below. The multi electron-beam source used in the image display apparatus of the present invention can use various electron-emitting devices such as surface-conduction type electron-emitting devices, FE type devices, or MIM type devices.

Under circumstances where inexpensive display apparatuses having large display areas are required, a cold cathode device, and particularly a surface-conduction type electron-emitting device is preferable among these devices. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, a surface-conduction type electron-emitting device can be manufactured by a relatively simple manufacturing method, and hence an increase in display area and a decrease in manufacturing cost can be attained. The present inventors have also found that among the surface-conduction type electron-emitting devices, an electron beam source having an electron-emitting portion or its peripheral portion consisting of a fine particle film is excellent in electron-emitting characteristic and can be easily manufactured. Such a device can therefore be most suitably used for the multi electron-beam source of a high-brightness, large-screen image display apparatus. For this reason, in the display panel of this embodiment, surface-conduction type electron-emitting devices each having an electron-emitting portion or its peripheral portion made of a fine particle film are used. The basic structure, manufacturing method, and characteristics of the preferred surface-conduction type electron-emitting device will be described first. The structure of the multi electron-beam source having many devices arranged in a simple matrix will be described later.

(Preferred Structure and Manufacturing Method of Surface-Conduction Type Electron-Emitting Device)

Typical examples of surface-conduction type electron-emitting devices each having an electron-emitting portion or its peripheral portion made of a fine particle film include two types of devices, namely flat and step type devices.

(Flat Surface-Conduction Type Electron-Emitting Device)

First, the structure and manufacturing method of a flat surface-conduction type electron-emitting device will be described.

Figure 23A:
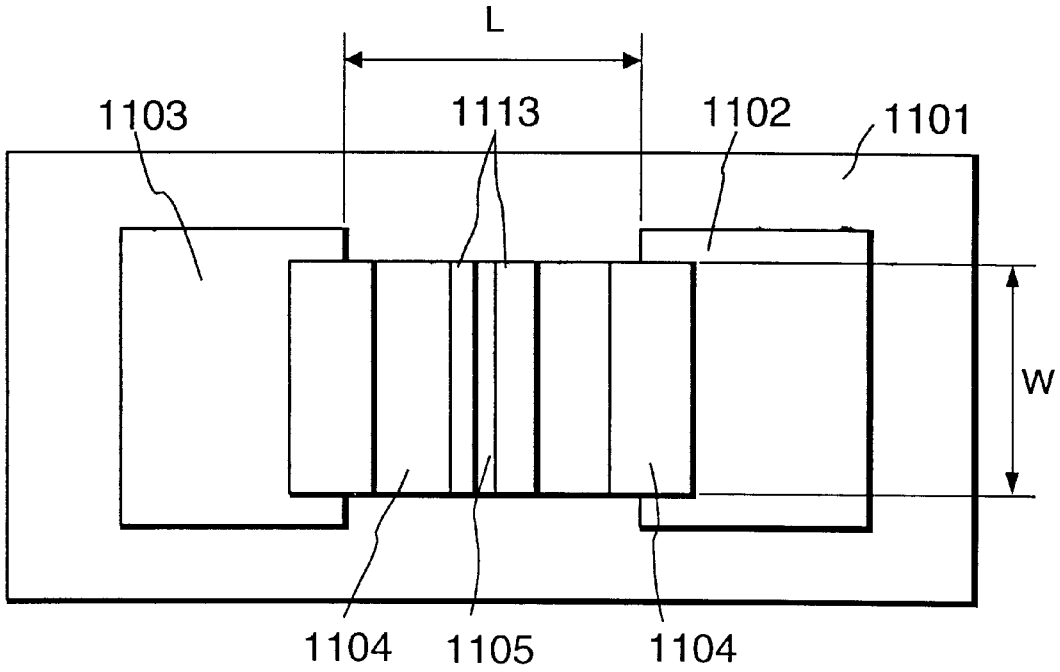
FIGS. 23A and 23B are a plan view and a sectional view, respectively, showing a flat surface-conduction type electron-emitting device used in the embodiment.
Figure 23B:
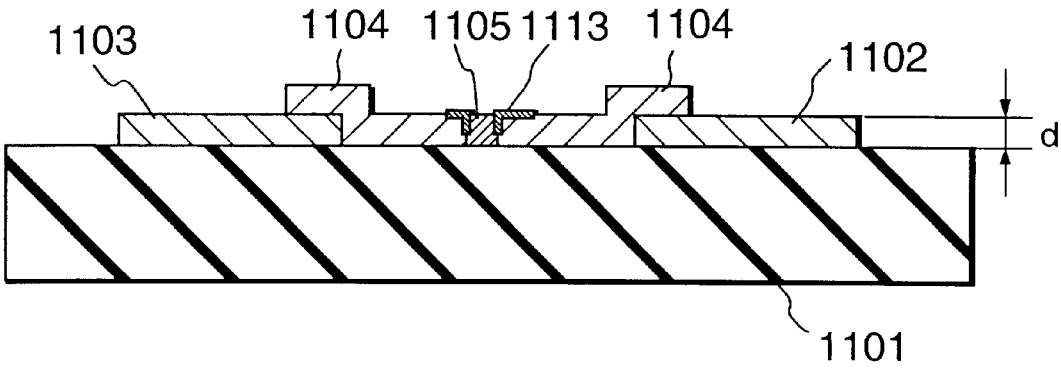

FIGS. 23A and 23B are a plan view and a sectional view, respectively, for explaining the structure of the flat surface-conduction type electron-emitting device. Referring to FIGS. 23A and 23B, reference numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with an insulating layer formed thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundred angstroms to hundred micrometers. Most preferable range for a display apparatus is from several micrometers to ten micrometers. As for electrode thickness d, an appropriate value is selected in a range from hundred angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle has a diameter within a range from several angstroms to thousand angstroms. Preferably, the diameter is within a range from 10 angstroms to 200 angstroms. The thickness of the fine particle film is appropriately set in consideration of conditions as follows. That is, condition necessary for electrical connection to the device electrode 1102 or 1103, condition for the forming processing to be described later, condition for setting electrical resistance of the fine particle film itself to an appropriate value to be described later etc. Specifically, the thickness of the film is set in a range from several angstroms to thousand angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIG. 23, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure is formed by the forming processing to be described later on the conductive thin film 1104. In some cases, particles, having a diameter of several angstroms to hundred angstroms, are arranged within the fissured portion. As it is difficult to exactly illustrate actual position and shape of the electron-emitting portion, therefore, FIG. 23 shoes the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less.

As it is difficult to exactly illustrate actual position or shape of the thin film 1113, FIG. 23 shows the film schematically. FIG. 23A shows the device where apart of the thin film 1113 is removed.

The preferred basic structure of the device is as described above. In the embodiment, the device has the following constituents.

That is, the substrate 1101 comprises a soda-lime glass, and the device electrodes 1102 and 1103, an Ni thin film.

The electrode thickness d is 1,000 angstroms and the electrode interval L is 2 $\mu$m.

The main material of the fine particle film is Pd or PdO. The thickness of the fine particle film is about 100 angstroms, and its width W is 100 $\mu$m.

Next, a method of manufacturing a preferred flat surface-conduction type electron-emitting device will be described.

FIGS. 24A to 24D are sectional views for explaining the manufacturing processes of the surface-conduction type electron-emitting device. Note that reference numerals are the same as those in FIG. 23.

Figure 24A:
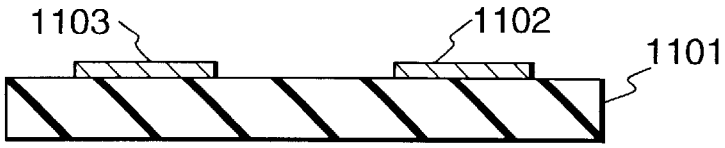
FIGS. 24A to 24E are sectional views showing the steps in manufacturing the flat surface-conduction type electron-emitting device.

1) First, as shown in FIG. 24A, the device electrodes 1102 and 1103 are formed on the substrate 1101.

In formation, first, the substrate 1101 is fully washed with a detergent, pure water and an organic solvent, then, material of the device electrodes is deposited there. (As a depositing method, a vacuum film-forming technique such as evaporation and sputtering may be used.) Thereafter, patterning using a photolithography etching technique is performed on the deposited electrode material. Thus, the pair of device electrodes (1102 and 1103) shown in FIG. 24A are formed.

Figure 24B:
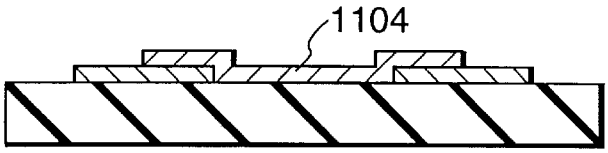

2) Next, as shown in FIG. 24B, the conductive thin film 1104 is formed.

In formation, first, an organic metal solvent is applied to the substrate in FIG. 24A, then the applied solvent is dried and sintered, thus forming a fine particle film. Thereafter, the fine particle film is patterned into a predetermined shape by the photolithography etching method. The organic metal solvent means a solvent of organic metal compound containing material of minute particles, used for forming the conductive thin film, as main component. (More specifically, Pd is used in this embodiment. In the embodiment, application of organic metal solvent is made by dipping, however, any other method such as a spinner method and spraying method may be employed.)

As a film-forming method of the conductive thin film made with the minute particles, the application of organic metal solvent used in the embodiment can be replaced with any other method such as a vacuum evaporation method, a sputtering method or a chemical vapor-phase accumulation method.

Figure 24C:
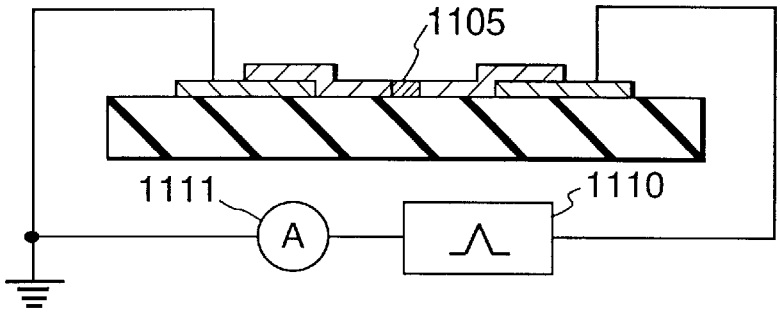

3) Then, as shown in FIG. 24C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 made of a fine particle film to appropriately destroy, deform, or deteriorate a part of the conductive thin film, thus changing the film to have a structure suitable for electron emission. In the conductive thin film made of the fine particle film, the portion changed for electron emission (i.e., electron-emitting portion 1105) has an appropriate fissure in the thin film. Comparing the thin film 1104 having the electron-emitting portion 1105 with the thin film before the forming processing, the electrical resistance measured between the device electrodes 1102 and 1103 has greatly increased.

Figure 25:
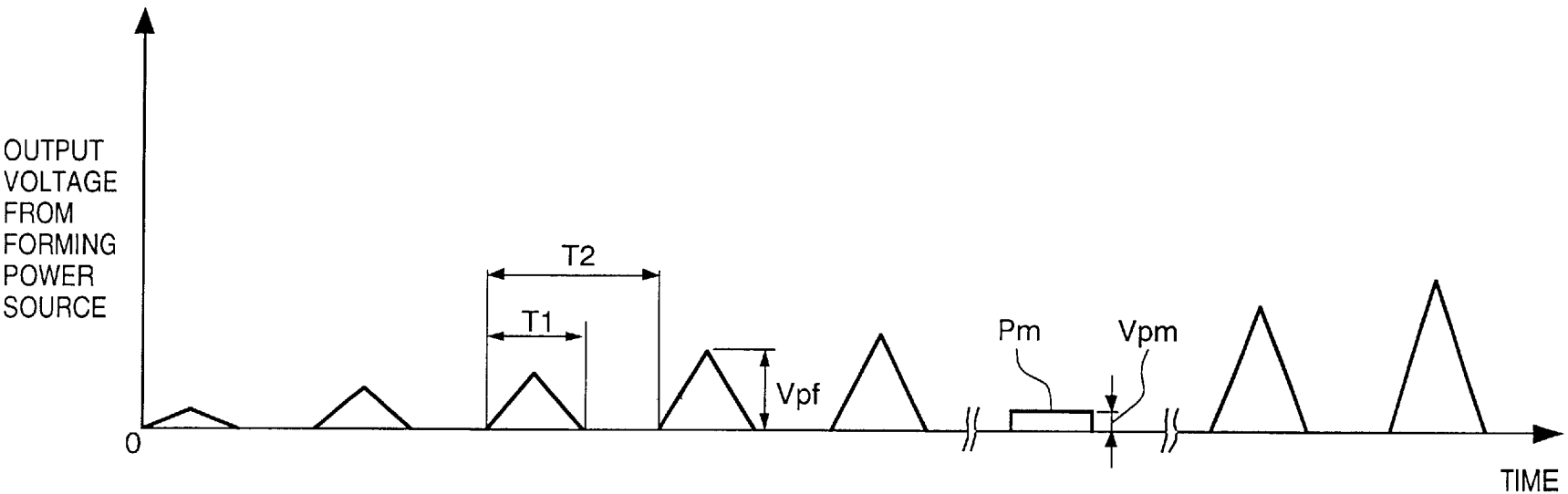
FIG. 25 is a graph showing the application voltage waveform in forming processing.

The electrification method will be explained in more detail with reference to FIG. 25 showing an example of waveform of appropriate voltage applied from the forming power source 1110. Preferably, in case of forming a conductive thin film of a fine particle film, a pulse-like voltage is employed. In this embodiment, as shown in FIG. 25, a triangular-wave pulse having a pulse width T1 is continuously applied at pulse interval of T2. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electrical resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable o the surface-conduction type electron-emitting device of this embodiment. In case of changing the design-of the surface-conduction type electron-emitting device concerning, e.g., the material or thickness of the fine particle film, or the device electrode interval L, the conditions for electrification are preferably changed in accordance with the change of device design.

Figure 24D:
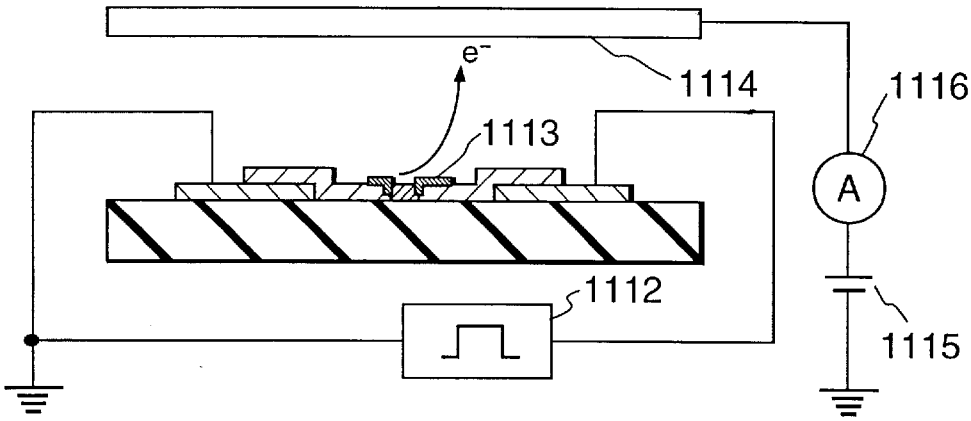

4) Next, as shown in FIG. 24D, appropriate voltage is applied, from an activation power source 1112, between the device electrodes 1102 and 1103, and the activation processing is performed to improve electron-emitting characteristic.

The activation processing here is electrification of the electron-emitting portion 1105 formed by the forming processing, on appropriate condition(s), for depositing carbon or carbon compound around the electron-emitting portion 1105. (In FIG. 24D, the deposited material of carbon or carbon compound is shown as material 1113.) Comparing the electron-emitting portion 1105 with that before the activation processing, the emission current at the same application voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 26A:
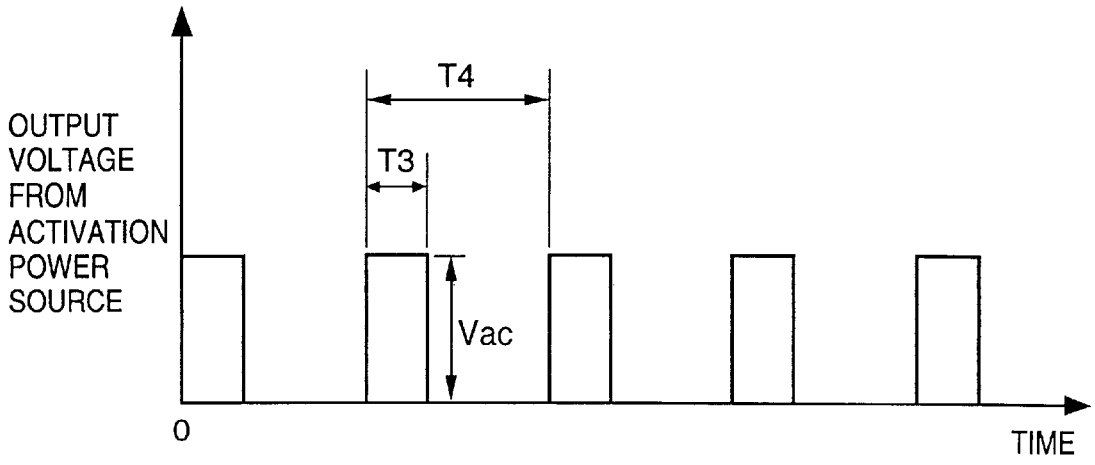
FIGS. 26A and 26B are graphs, respectively, showing changes in application voltage waveform and emission current Ie in the activation processing.

The electrification method will be described in more detail with reference to FIG. 26A showing an example of waveform of appropriate voltage applied from the activation power source 1112. In this embodiment, the activation processing is performed by periodically applying a rectangular wave at a predetermined voltage. A rectangular-wave voltage Vac is set to 14 V; a pulse width T3, to 1 msec; and a pulse interval T4, to 10 msec. Note that the above electrification conditions are preferable for the surface-conduction type electron-emitting device of the embodiment. In the case in which the design of the surface-conduction type electron-emitting device is changed, the electrification conditions are preferably changed in accordance with the change of device design.

In FIG. 24D, reference numeral 1114 denotes an anode electrode, connected to a direct-current (DC) high-voltage power source 1115 and a galvanometer 1116, for capturing emission current Ie emitted from the surface-conduction type electron-emitting device. (In the case in which the substrate 1101 is incorporated into the display panel before the activation processing, the Al layer on the fluorescent surface of the display panel is used as the anode electrode 1114.)

Figure 26B:
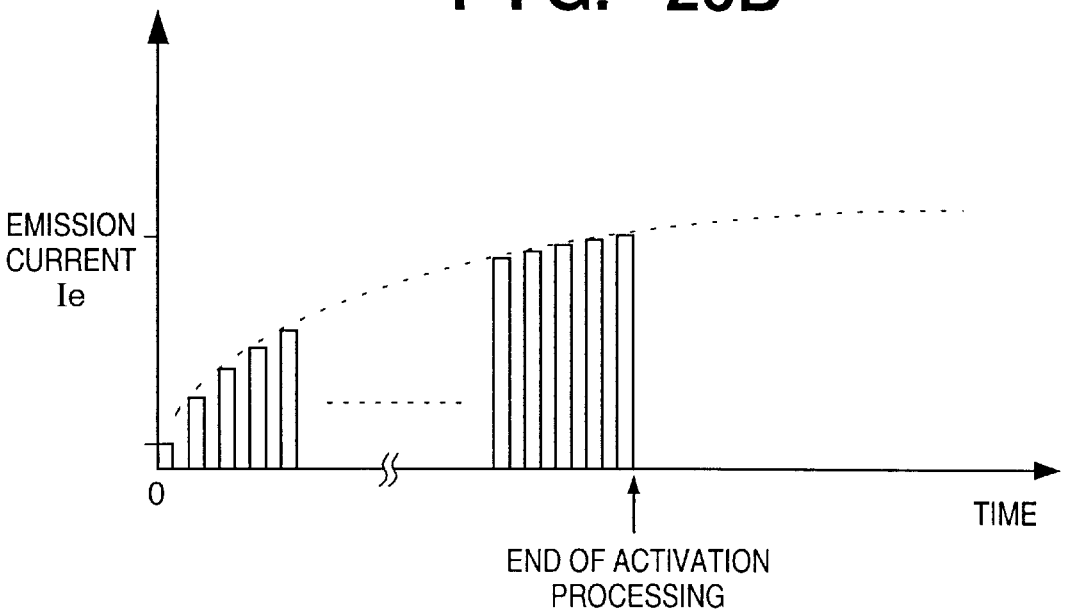

While applying voltage from the activation power source 1112, the galvanometer 1116 measures the emission current Ie, thus monitors the progress of activation processing, to control the operation of the activation power source 1112. FIG. 26B shows an example of the emission current Ie measured by the galvanometer 1116. As application of pulse voltage from the activation power source 1112 is started in this manner, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the surface-conduction type electron-emitting device of the embodiment. In case of changing the design of the surface-conduction type electron-emitting device, the conditions are preferably changed in accordance with the change of device design.

Figure 24E:
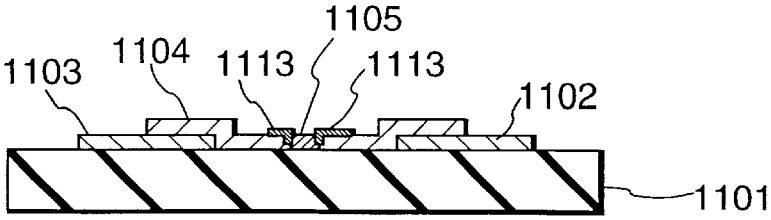

As described above, the surface-conduction type electron-emitting device as shown in FIG. 24E is manufactured.

(Step Surface-Conduction Type Electron-Emitting Device)

Next, another typical structure of the surface-conduction type electron-emitting device where an electron-emitting portion or its peripheral portion is formed of a fine particle film, i.e., a stepped surface-conduction type electron-emitting device will be described.

Figure 27:
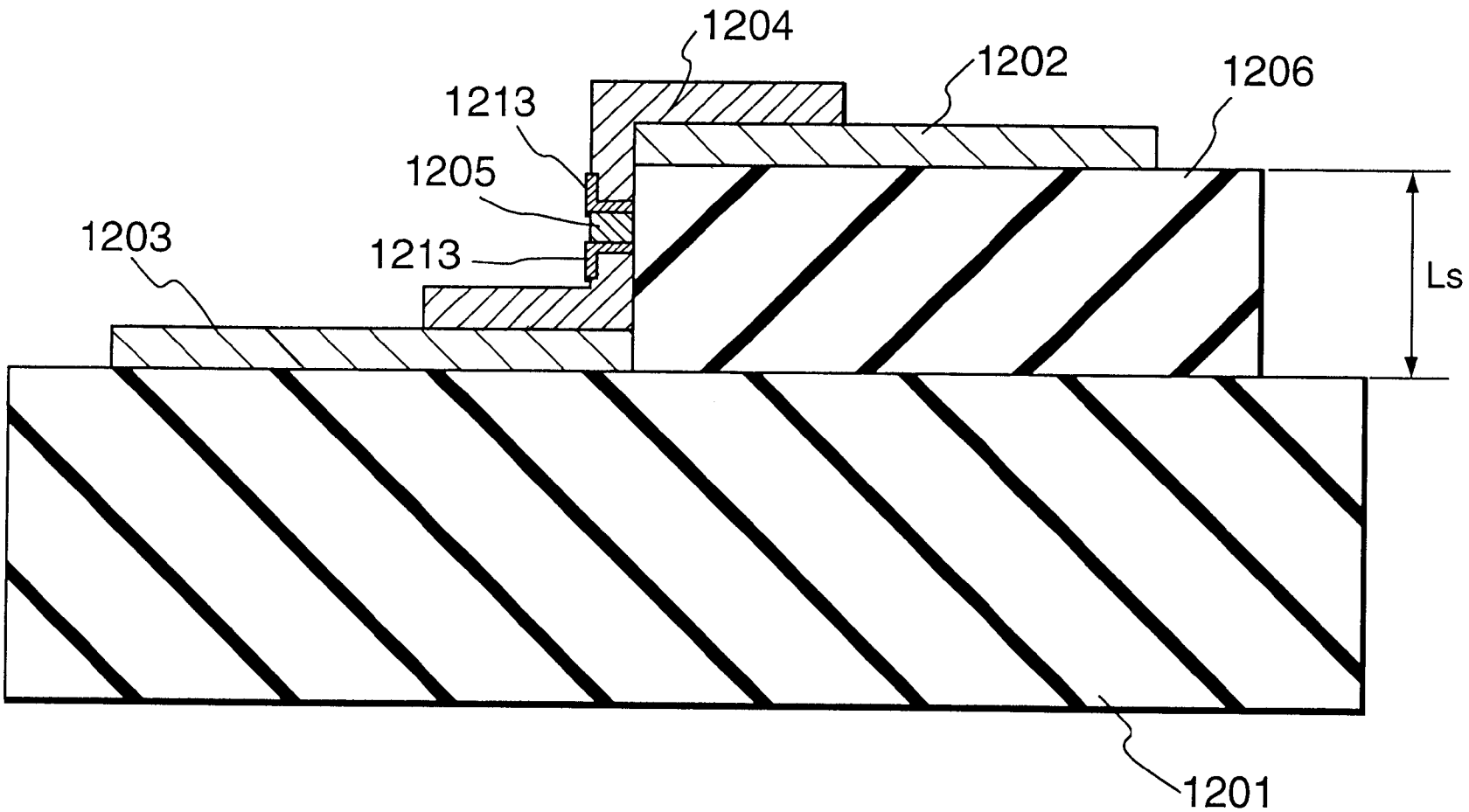
FIG. 27 is a sectional view showing a step surface-conduction type electron-emitting device used in the embodiment.

FIG. 27 is a sectional view schematically showing the basic construction of the step surface-conduction type electron-emitting device. Referring to FIG. 27, reference numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by the forming processing; and 1213, a thin film formed by the activation processing.

Difference between the step device from the above-described flat device is that one of the device electrodes (1202 in this example) is provided on the step-forming member 1206 and the conductive thin film 1204 covers the side surface of the step-forming member 1206. The device interval L in FIG. 23A is set in this structure as a height difference Ls corresponding to the height of the step-forming member 1206. Note that the substrate 1201, device electrodes 1202 and 1203, conductive thin film 1204 using the fine particle film can comprise the materials given in the explanation of the flat surface-conduction type electron-emitting device. Further, the step-forming member 1206 comprises electrically insulating material such as $SiO_2$.

Next, a method of manufacturing the stepped surface-conduction type electron-emitting device will be described with reference FIGS. 28A to 28F which are sectional views showing the manufacturing processes. In these figures, reference numerals of the respective parts are the same as those in FIG. 27.

Figure 28A:
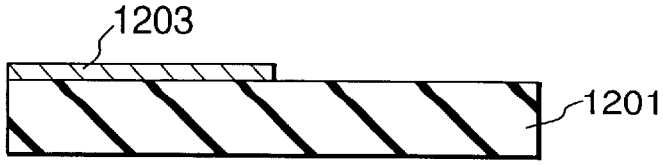
FIGS. 28A to 28F are sectional views showing the steps in manufacturing the step surface-conduction type electron-emitting device.

1) First, as shown in FIG. 28A, the device electrode 1203 is formed on the substrate 1201.

Figure 28B:
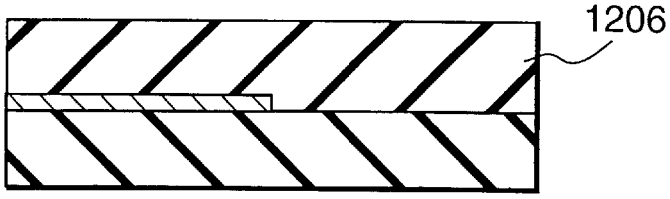

2) Next, as shown in FIG. 28B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 28C:
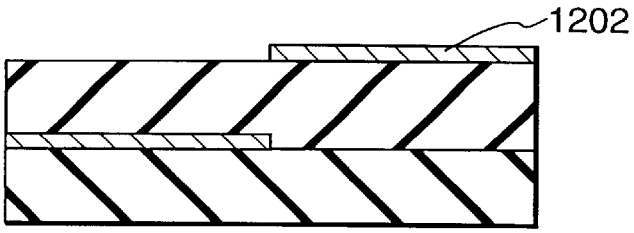

3) Next, as shown in FIG. 28C, the device electrode 1202 is formed on the insulating layer.

Figure 28D:
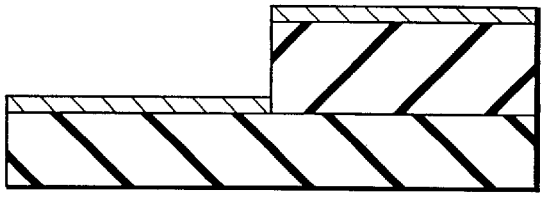

4) Next, as shown in FIG. 28D, a part of the insulating layer is removed by using, e.g., an etching method, to expose the device electrode 1203.

Figure 28E:
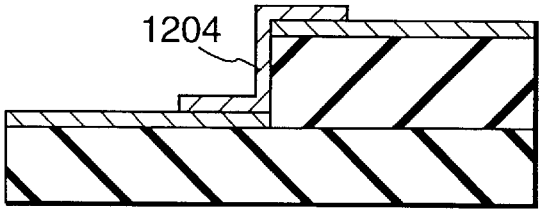

5) Next, as shown in FIG. 28E, the conductive thin film 1204 using the fine particle film is formed. Upon formation, similar to the above-described flat device structure, a film-forming technique such as an applying method is used.

6) Next, similar to the flat device structure, the forming processing is performed to form an electron-emitting portion. (The forming processing similar to that explained using FIG. 24C may be performed.)

7) Next, similar to the flat device structure, the activation processing is performed to deposit carbon or carbon compound around the electron-emitting portion. (Activation processing similar to that explained using FIG. 24D may be performed).

Figure 28F:
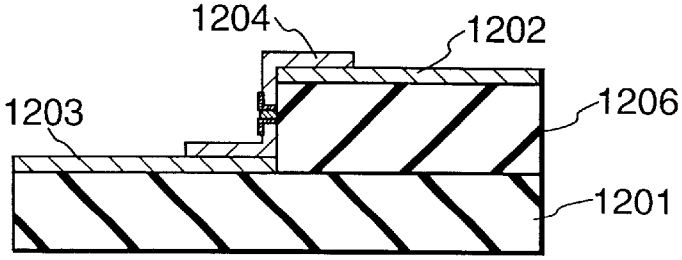

As described above, the stepped surface-conduction type electron-emitting device shown in FIG. 28F is manufactured.

(Characteristic of Surface-Conduction Type Electron-Emitting Device Used in Display Apparatus)

The structure and manufacturing method of the flat surface-conduction type electron-emitting device and those of the stepped surface-conduction type electron-emitting device are as described above. Next, the characteristic of the electron-emitting device used in the display apparatus will be described below.

Figure 29:
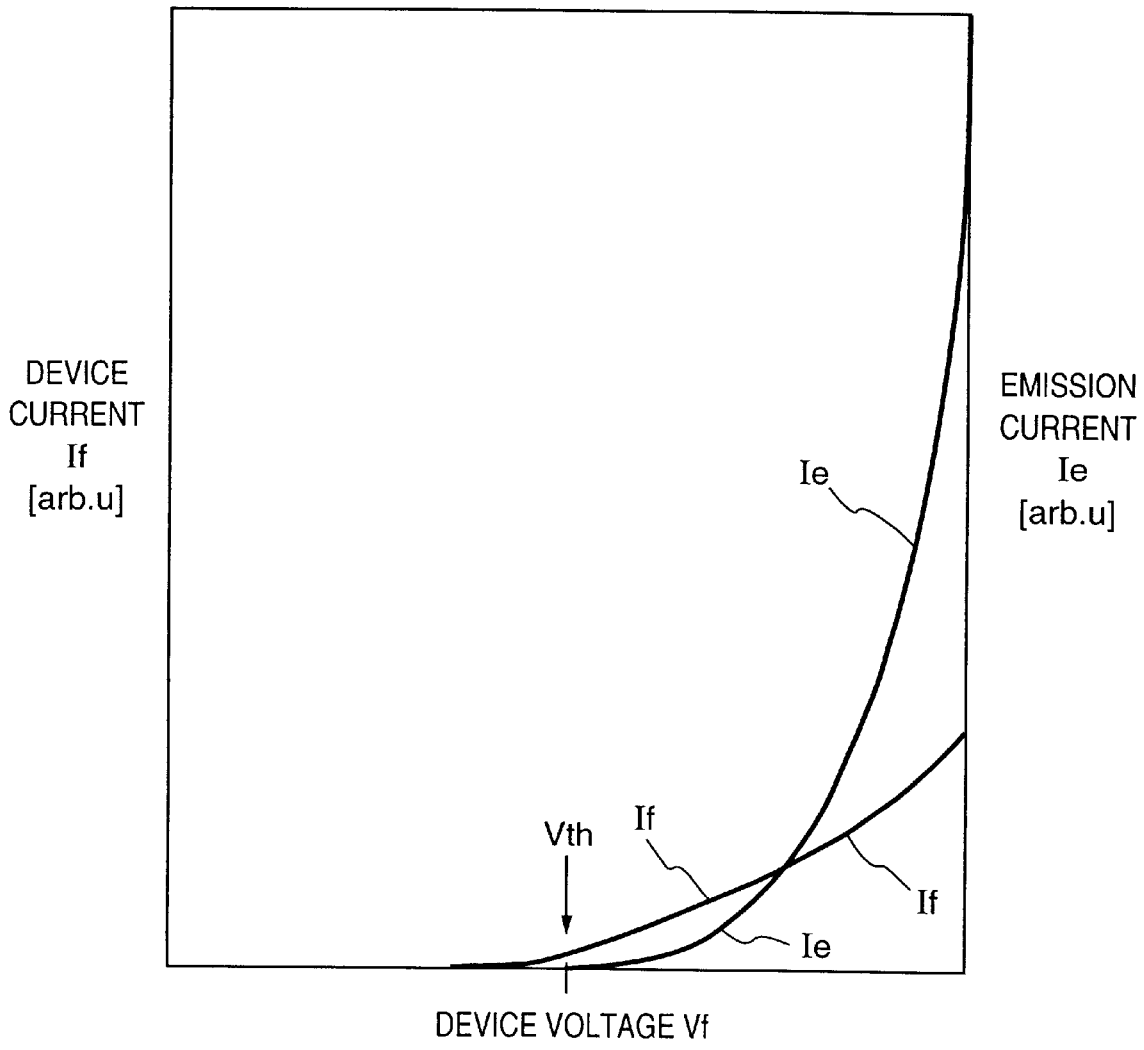
FIG. 29 is a graph showing the typical characteristics of the surface-conduction type electron-emitting device used in the embodiment.

FIG. 29 shows a typical example of (emission current Ie) to (device application voltage Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 29 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected.

That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the emission current Ie is output quickly in response to application of the device voltage Vf to the device. Accordingly, an electrical charge amount of electrons to be emitted from the device can be controlled by changing period of application of the device voltage Vf.

The surface-conduction type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device in accordance with a desired emission luminance, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-level display.

(Structure of Multi Electron-Beam Source With Many Devices Arranged in Simple Matrix)

Next, the structure of the multi electron-beam source having the above-described surface-conduction type electron-emitting devices arranged on the substrate with the simple-matrix wiring will be described below.

Figure 30:
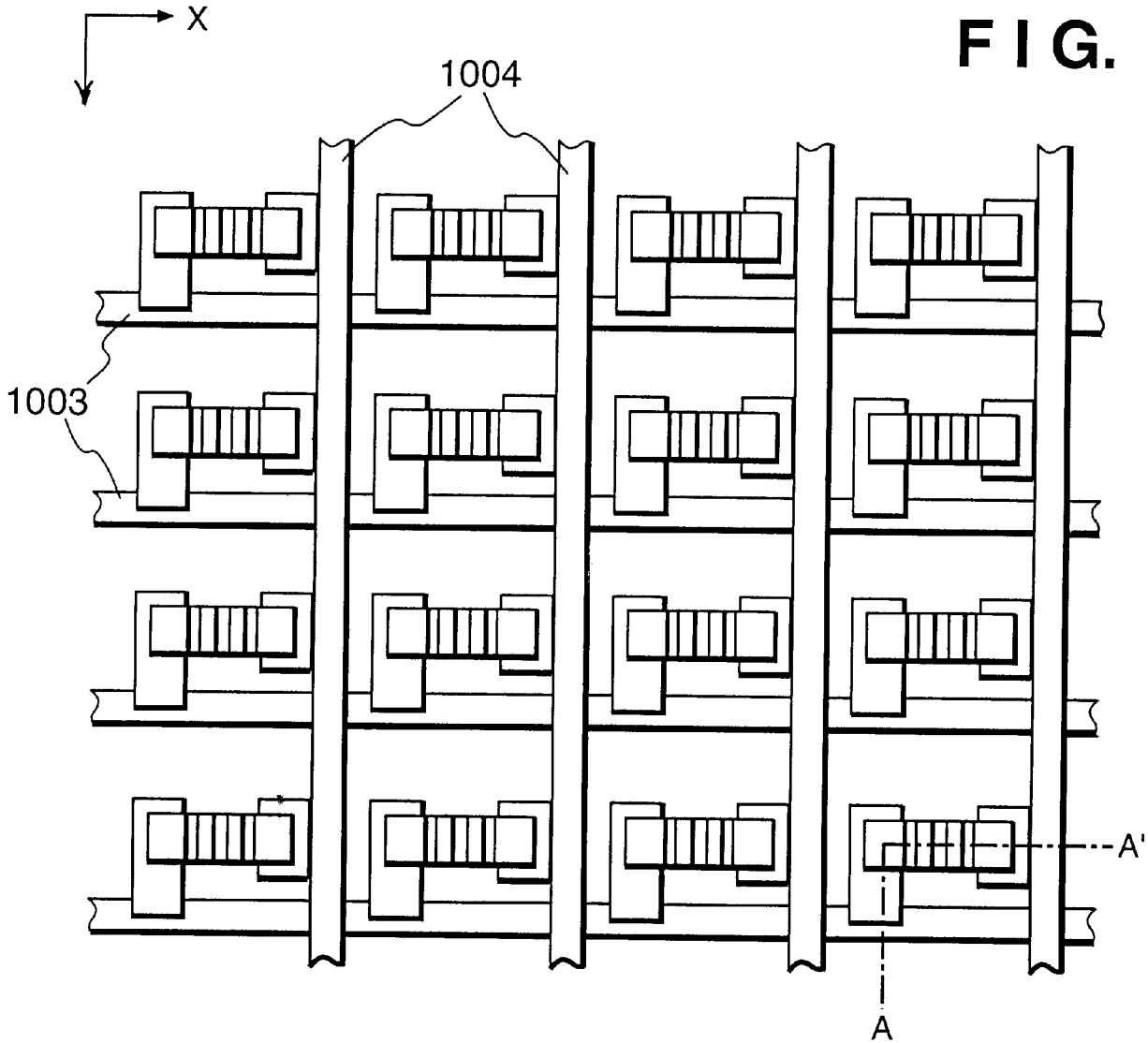
FIG. 30 is a plan view showing the substrate of a multi electron-beam source used in the embodiment.

FIG. 30 is a plan view of the multi electron-beam source used in the display panel in FIG. 21. There are surface-conduction type electron-emitting devices like the one shown in FIG. 23 on a substrate. These devices are arranged in a simple matrix with the row-direction wiring 1003 and the column-direction wiring 1004. At an intersection of the wirings 1003 and 1004, an insulating layer (not shown) is formed between the wires, to maintain electrical insulation.

Figure 31:
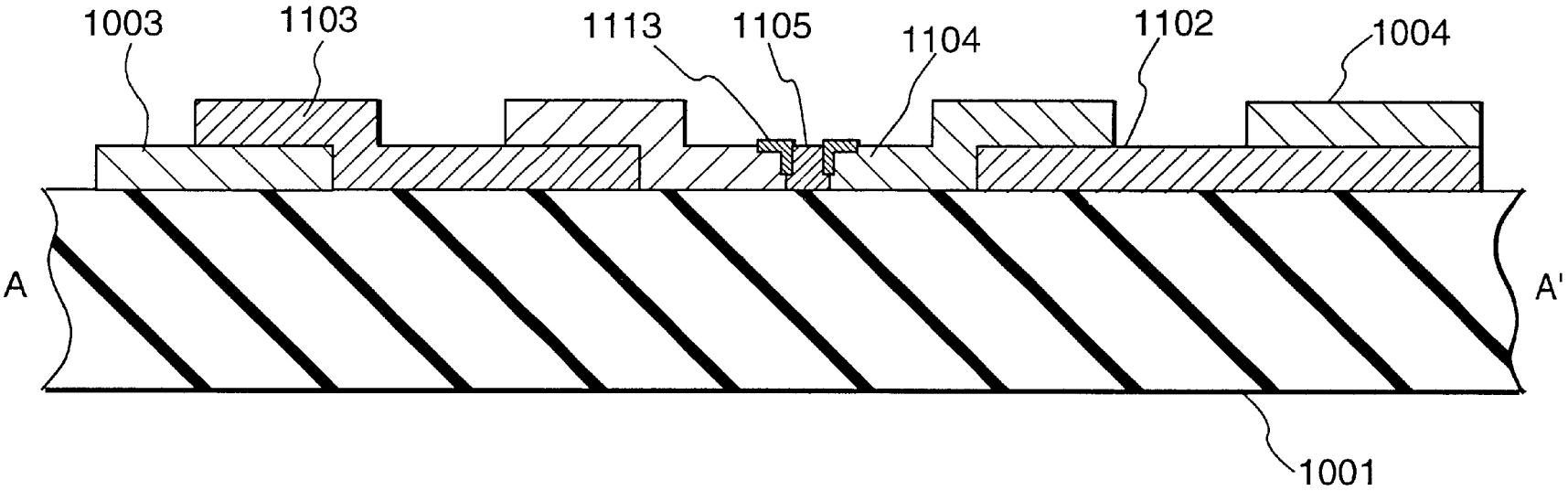
FIG. 31 is a sectional view showing part of the substrate of the multi electron-beam source used in the embodiment.

FIG. 31 shows a cross-section cut out along the line A–A' in FIG. 30.

Note that a multi electron-beam source having such a structure is manufactured by forming the row- and column-direction wirings 1003 and 1004, the inter-electrode insulating layers (not shown), and the device electrodes and conductive thin films of the surface-conduction type electron-emitting devices on the substrate, then supplying electricity to the respective devices via the row- and column-direction wirings 1003 and 1004, thus performing the forming processing and the activation processing.

FIG. 32 is a block diagram showing an example of a display apparatus capable of displaying image information provided from various image information sources such as television broadcasting on a display panel using the surface-conduction type electron-emitting device of this embodiment as an electron-beam source.

Referring to FIG. 32, reference numeral 2100 denotes a display panel; 2101, a driving circuit for the display panel; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit; 2112 and 2113, TV signal reception circuits; and 2114, an input portion. (Note that in the display apparatus, upon reception of a signal containing both video information and audio information such as a TV signal, the video information is displayed while the audio information is reproduced. A description of a circuit or a speaker for reception, division, reproduction, processing, storage, or the like of the audio information, which is not directly related to the features of the present invention, will be omitted.)

The functions of the respective parts will be explained in accordance with the flow of an image signal.

The TV signal reception circuit 2113 receives a TV image signal transmitted using a radio transmission system such as radio waves or spatial optical communication. The scheme of the TV signal to be received is not particularly limited, and is the NTSC scheme, the PAL scheme, the SECAM scheme, or the like. A more preferable signal source to take the advantages of the display panel realizing a large area and a large number of pixels is a TV signal (e.g., a so-called high-quality TV of the MUSE scheme or the like) made up of a larger number of scanning lines than that of the TV signal of the above scheme. The TV signal received by the TV signal reception circuit 2113 is output to the decoder 2104.

The TV signal reception circuit 2112 receives a TV image signal transmitted using a wire transmission system such as a coaxial cable or optical fiber. The scheme of the TV signal to be received is not particularly limited, as in the TV signal reception circuit 2113. The TV signal received by the circuit 2112 is also output to the decoder 2104.

The image input interface circuit 2111 receives an image signal supplied from an image input device such as a TV camera or image read scanner, and outputs it to the decoder 2104.

The image memory interface circuit 2110 receives an image signal stored in a video tape recorder (to be briefly referred to as a VTR hereinafter), and outputs it to the decoder 2104.

The image memory interface circuit 2109 receives an image signal stored in a video disk, and outputs it to the decoder 2104.

The image memory interface circuit 2108 receives an image signal from a device storing still image data such as a so-called still image disk, and outputs the received still image data to the decoder 2104.

The I/O interface circuit 2105 connects the display apparatus to an external computer, computer network, or output device such as a printer. The I/O interface circuit 2105 allows inputting/outputting image data, character data, and graphic information, and in some cases inputting/outputting a control signal and numerical data between the CPU 2106 of the display apparatus and an external device.

The image generation circuit 2107 generates display image data on the basis of image data or character/graphic information externally input via the I/O interface circuit 2105, or image data or character/graphic information output from the CPU 2106. This circuit 2107 incorporates circuits necessary to generate images such as a programmable memory for storing image data and character/graphic information, a read-only memory storing image patterns corresponding to character codes, and a processor for performing image processing.

Display image data generated by the circuit 2107 is output to the decoder 2104. In some cases, display image data can also be input/output from/to an external computer network or printer via the I/O interface circuit 2105.

The CPU 2106 mainly performs control of operation of this display apparatus, and operations about generation, selection, and editing of display images.

For example, the CPU 2106 outputs a control signal to the multiplexer 2103 to properly select or combine image signals to be displayed on the display panel. At this time, the CPU 2106 generates a control signal to the display panel controller 2102 in accordance with the image signals to be displayed, and appropriately controls operation of the display apparatus in terms of the screen display frequency, the scanning method (e.g., interlaced or non-interlaced scanning), the number of scanning lines for one frame, and the like.

The CPU 2106 directly outputs image data or character/graphic information to the image generation circuit 2107. In addition, the CPU 2106 accesses an external computer or memory via the I/O interface circuit 2105 to input image data or character/graphic information.

The CPU 2106 may also be concerned with operations for other purposes. For example, the CPU 2106 can be directly concerned with the function of generating and processing information, like a personal computer or word processor.

Alternatively, the CPU 2106 may be connected to an external computer network via the I/O interface circuit 2105 to perform operations such as numerical calculation in cooperation with the external device.

The input portion 2114 allows the user to input an instruction, program, or data to the CPU 2106. As the input portion 2114, various input devices such as a joystick, bar code reader, and speech recognition device are available in addition to a keyboard and mouse.

The decoder 2104 inversely converts various image signals input from the circuits 2107 to 2113 into three primary color signals, or a luminance signal and I and Q signals. As is indicated by the dotted line in FIG. 32, the decoder 2104 desirably incorporates an image memory in order to process a TV signal of the MUSE scheme or the like which requires an image memory in inverse conversion. This image memory advantageously facilitates display of a still image, or image processing and editing such as thinning, interpolation, enlargement, reduction, and synthesis of images in cooperation with the image generation circuit 2107 and CPU 2106.

The multiplexer 2103 appropriately selects a display image on the basis of a control signal input from the CPU 2106. More specifically, the multiplexer 2103 selects a desired one of the inversely converted image signals input from the decoder 2104, and outputs the selected image signal to the driving circuit 2101. In this case, the image signals can be selectively switched within a 1-frame display time to display different images in a plurality of areas of one frame, like a so-called multi window television.

The display panel controller 2102 controls operation of the driving circuit 2101 on the basis of a control signal input from the CPU 2106.

As for the basic operation of the display panel, the display panel controller 2102 outputs, e.g., a signal for controlling the operation sequence of a driving power source (not shown) of the display panel to the driving circuit 2101.

As for the method of driving the display panel, the display panel controller 2102 outputs, e.g., a signal for controlling the screen display frequency or scanning method (e.g., interlaced or non-interlaced scanning) to the driving circuit 2101.

In some cases, the display panel controller 2102 outputs to the driving circuit 2101 a control signal about adjustment of the image quality such as the brightness, contrast, color tone, or sharpness of a display image.

The driving circuit 2101 generates a driving signal to be applied to the display panel 2100, and operates based on an image signal input from the multiplexer 2103 and a control signal input from the display panel controller 2102.

The functions of the respective parts have been described. The arrangement of the display apparatus shown in FIG. 32 makes it possible to display image information input from various image information sources on the display panel 2100.

More specifically, various image signals such as television broadcasting image signals are inversely converted by the decoder 2104, appropriately selected by the multiplexer 2103, and supplied to the driving circuit 2101. On the other hand, the display controller 2102 generates a control signal for controlling operation of the driving circuit 2101 in accordance with an image signal to be displayed. The driving circuit 2101 applies a driving signal to the display panel 2100 on the basis of the image signal and control signal.

As a result, the image is displayed on the display panel 2100. A series of operations are systematically controlled by the CPU 2106.

In the display apparatus, the image memory incorporated in the decoder 2104, the image generation circuit 2107, and the CPU 2106 can cooperate with each other to simply display selected ones of a plurality of pieces of image information and to perform, for the image information to be displayed, image processing such as enlargement, reduction, rotation, movement, edge emphasis, thinning, interpolation, color conversion, and conversion of the aspect ratio of an image, and image editing such as synthesis, erasure, connection, exchange, and pasting. Although not described in this embodiment, an audio circuit for processing and editing audio information may be arranged, similar to the image processing and the image editing.

The display apparatus can therefore function as a display device for television broadcasting, a terminal device for video conferences, an image editing device processing still and dynamic images, a terminal device for a computer, an office terminal device such as a word processor, a game device, and the like. This display apparatus are useful for industrial and business purposes and can be variously applied.

FIG. 32 merely shows an example of the arrangement of the display apparatus using the display panel having the surface-conduction type electron-emitting device as an electron-beam source. The present invention is not limited to this, as a matter of course. For example, among the constituents in FIG. 32, a circuit associated with a function unnecessary for the application purpose can be eliminated from the display apparatus. To the contrary, another constituent can be added to the display apparatus in accordance with the application purpose. For example, when the display apparatus is used as a television telephone set, transmission and reception circuits including a television camera, audio microphone, lighting, and modem are preferably added as constituents.

In the display apparatus, since particularly the display panel using the surface-conduction type electron-emitting device as an electron-beam source can be easily made thin, the width of the whole display apparatus can be decreased. In addition to this, the display panel using the surface-conduction type electron-emitting device as an electron-beam source is easily increased in screen size and has a high brightness and a wide view angle. This display apparatus can therefore display an impressive image with reality and high visibility.

As described in problem (1), the driver is desired to reduce power consumption. This embodiment can minimize the column wiring driving output amplitude to reduce the power consumption of the column wiring driver. A low output amplitude voltage and small power consumption can increase the integration degree of an integrated circuit of the driver.

As described in problem (2), the emission/non-emission threshold voltage may slightly vary depending on the accelerating voltage of an emitted electron beam or the panel lot. However, variations in threshold voltage can be absorbed by providing a means for changing the row selection voltage −Vy, or a means capable of changing the potential difference Vb between the first and second reference voltage levels when the column wiring driver receives a plurality of luminance signals from the luminance signal sampling means every horizontal period and outputs a signal within the voltage amplitude range from the second reference voltage level having the potential difference Vb from the first reference voltage level, to the maximum peak value Vx.

Problem (3):

This embodiment comprises a means for changing the range of the output peak value (which changes in accordance with a luminance signal) of the column wiring driver. By changing the output peak value in accordance with a user request or power consumption suppression request, a high-quality display image can be obtained.

Problem (4):

This embodiment comprises a means for determining the type of input video signal. By determining the range of the output peak value of the column wiring driver on the basis of the determination result, a high-quality display image can be obtained.

Problem (5):

This embodiment can obtain a high-quality display image like a CRT.

Problem (6):

This embodiment appropriately controls an emission color when the luminance level of an input signal is as low as almost black, an emission color when the luminance level of an input signal is as high as almost the maximum emission luminance, and an emission color when an input luminance signal changes from black to white. Thus, a high-quality display image can be obtained.

Problem (7):

This embodiment can protect the device from application of a device voltage equal to or higher than the rated voltage, and can obtain a high-quality display image.

As has been described above, the present invention can realize a preferable image forming apparatus and image forming method.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

a plurality of electron-emitting devices arranged in a matrix and including a plurality of first and second wirings;

a light-emitting substance for emitting light by irradiation of electrons emitted by said electron-emitting devices;

a first driving circuit for applying a scanning selection potential to selected first wirings and for applying a non-selection potential to said first wirings other than the selected first wirings; and a second driving circuit for applying a driving potential corresponding to an image signal to the plurality of second wirings, wherein said first and second driving circuits drive said plurality of electron-emitting devices in accordance with the following condition, $$Vx<Vy' \text{ and } Vy'>Vth,$$

where Vth represents a threshold voltage to be applied to an electron-emitting device for emitting electrons needed for the light-emitting substance to emit light, Vx represents a potential difference between a maximum potential corresponding to a maximum luminance level and a minimum potential corresponding to a minimum luminance level among driving potentials selectable based on luminance of the image signal, and Vy' represents a potential difference between the minimum potential and the scanning selection potential.

2. The apparatus according to claim 1, further comprising an offset potential generator arranged to generate the potential Vy' by adding an offset potential Vb to the driving potential.

3. The apparatus according to claim 1, further comprising a reference potential generator arranged to generate a reference voltage for adjusting the potential Vx.

4. The apparatus according to claim 2, wherein said light-emitting substance includes three types of light-emitting substances for emitting light of three colors, and offset potentials for each color can be adjusted independently.

5. The apparatus according to claim 3, wherein said light-emitting substance includes three types of light-emitting substances for emitting light of three colors, and reference voltages for each color can be adjusted independently.

6. An image forming apparatus comprising:

a plurality of electron-emitting devices arranged in a matrix using a plurality of first and second wirings;

a light-emitting substance for emitting light by irradiation of electrons emitted by said electron-emitting devices;

a first driving circuit for applying a scanning selection potential to selected first wirings and for applying a non-selection potential to first wirings other than said selected first wirings;

a second driving circuit for applying a driving potential corresponding to an image signal to said plurality of second wirings;

an offset voltage generating unit for generating a potential Vy' by adding an offset potential Vb to said driving potential, wherein said offset voltage generating unit generates the potential Vy' in accordance with the following condition, $$Vx<Vy' \text{ and } Vy'\approx Vth,$$

where Vth represents a threshold voltage to be applied to an electron-emitting device for emitting electrons needed for the light-emitting substance to emit light, Vx represents a potential difference between a maximum potential corresponding to a maximum luminance level and a minimum potential corresponding to a minimum luminance level among driving potentials selectable based on luminance of the image signal, and Vy' represents a potential difference between the minimum potential and the scanning selection potential.

7. A driving circuit of an image forming apparatus having a plurality of electron-emitting devices arranged in a matrix using a plurality of first and second wirings and a light-emitting substance for emitting light by irradiation of electrons emitted by said electron-emitting devices, said circuit comprising:

a first driving circuit for applying a scanning selection potential to selected first wirings and for applying a non-selection potential to said first wirings other than the selected first wirings; and a second driving circuit for applying a driving potential corresponding to an image signal to the plurality of second wirings, wherein said first and second driving circuits drives the plurality of electron-emitting devices in accordance with the following condition, $$Vx<Vy' \text{ and } Vy'>Vth,$$

where Vth represents a threshold voltage to be applied to an electron-emitting device for emitting electrons needed for the light-emitting substance to emit light, Vx represents a potential difference between a maximum potential corresponding to a maximum luminance level and a minimum potential corresponding to a minimum luminance level among driving potentials selectable based on luminance of the image signal, and Vy' represents a potential difference between the minimum potential and the scanning selection potential.

8. The apparatus according to claim 7, further comprising an offset potential generator arranged to generate the potential Vy' by adding an offset potential Vb to the driving potential.

9. The apparatus according to claim 7, further comprising a reference potential generator arranged to generate a reference voltage for adjusting the potential Vx.

10. The apparatus according to claim 8, wherein said light-emitting substance includes three types of light-emitting substances for emitting light of three colors, and the offset potentials for each color can be adjusted independently.

11. The apparatus according to claim 9, wherein said light-emitting substance includes three types of light-emitting substances for emitting light of three colors, and the reference voltages for each color can be adjusted independently.

12. A driving circuit of an image forming apparatus having a plurality of electron-emitting devices arranged in a matrix using a plurality of first and second wirings and a light-emitting substance for emitting light by irradiation of electrons emitted by said electron-emitting devices, said circuit comprising:

a first driving circuit for applying a scanning selection potential to selected first wirings and for applying a non-selection potential to the first wirings other than the selected first wirings; and a second driving circuit for applying a driving potential corresponding to an image signal to the plurality of second wirings;

an offset voltage generating unit for generating a potential Vy' by adding an offset potential Vb to said driving potential, wherein said offset voltage generating unit generates the potential Vy' in accordance with the following condition, $$Vx<Vy' \text{ and } Vy'\approx Vth,$$

where Vth represents a threshold voltage to be applied to an electron-emitting device for emitting electrons needed for the light-emitting substance to emit light, Vx represents a potential difference between a maximum potential corresponding to a maximum luminance level and a minimum potential corresponding to a minimum luminance level among driving potentials selectable based on luminance of the image signal, and Vy' represents a potential difference between the minimum potential and the scanning selection potential.

13. A driving method for driving an image forming apparatus having a plurality of electron-emitting devices arranged in a matrix using a plurality of first and second wirings and a light-emitting substance for emitting light by irradiation of electrons emitted by the electron-emitting devices, said method comprising the steps of:

applying a scanning selection potential to selected first wirings and applying a non-selection potential to first wirings other than the selected first wirings; and applying a driving potential corresponding to an image signal to the plurality of second wirings, wherein said applying steps drive the plurality of electron-emitting devices in accordance with the following condition, $$Vx<Vy' \text{ and } Vy'>Vth,$$

where Vth represents a threshold voltage to be applied to an electron-emitting device for emitting electrons needed for the light-emitting substance to emit light, Vx represents a potential difference between a maximum potential corresponding to a maximum luminance level and a minimum potential corresponding to a minimum luminance level among driving potentials selectable based on luminance of the image signal, and Vy' represents a potential difference between the minimum potential and the scanning selection potential.

14. The method of claim 13, further comprising an offset potential generating step of generating the potential Vy' by adding an offset potential Vb to the driving potential.

15. The method according to claim 13, further comprising a reference potential generating step of generating a reference voltage for adjusting the potential Vx.

16. The method according to claim 14, wherein the light-emitting substance includes three types of light-emitting substances for emitting light of three colors, and the offset potentials for each color can be adjusted independently.

17. The method according to claim 15, wherein the light-emitting substance includes three types of light-emitting substances for emitting light of three colors, and the reference voltages for each color can be adjusted independently.

18. A driving method for driving an image forming apparatus having a plurality of electron-emitting devices arranged in a matrix using a plurality of first and second wirings and a light-emitting substance for emitting light by irradiation of electrons emitted by the electron-emitting devices, said method comprising the steps of:

applying a scanning selection potential to a plurality of first wirings and applying a non-selection potential to the first wirings other than the selected first wirings;

applying a driving potential corresponding to an image signal to the plurality of second wirings; and generating a potential Vy' by adding an offset potential Vb to said driving potential, wherein said offset potential Vy' is generated in accordance with the following condition, $$Vx<Vy' \text{ and } Vy'\approx Vth,$$

where Vth represents a threshold voltage to be applied to an electron-emitting device for emitting electrons needed for the light-emitting substance to emit light, Vx represents a potential difference between a maximum potential corresponding to a maximum luminance level and a minimum potential corresponding to a minimum luminance level among driving potentials selectable based on luminance of the image signal, and Vy' represents a potential difference between the minimum potential and the scanning selection potential.

* * * * *

UNITED STATES PATENT AND TRADEMARK OFFICE

CERTIFICATE OF CORRECTION

PATENT NO. : 6,603,450 B1
DATED : August 5, 2003
INVENTOR(S) : Tatsuro Yamazaki et al.

It is certified that error appears in the above-identified patent and that said Letters Patent is hereby corrected as shown below:

Title page,
Item [56], References Cited, OTHER PUBLICATIONS, "LETT," should read -- LETI, --.

Column 3,
Line 3, "Meyeret" should read -- Meyer et --.
Line 4, "LETT," should read -- LETI, --.

Column 6,
Line 26, "adesir-" should read -- a desir- --.

Column 14,
Line 35, "X ENA." should read -- X_ENA. --.

Column 24,
Line 48, "shoes" should read -- shows --.

Column 25,
Line 33, "dipping," should read -- dipping; --.

Column 26,
Line 18, "o the" should read -- to the --.

Signed and Sealed this

Ninth Day of March, 2004

JON W. DUDAS
*Acting Director of the United States Patent and Trademark Office*